US010060222B2

(12) United States Patent
Saltel et al.

(10) Patent No.: US 10,060,222 B2
(45) Date of Patent: Aug. 28, 2018

(54) INSULATION DEVICE FOR A WELL

(71) Applicant: Saltel Industries, Bruz (FR)

(72) Inventors: Jean-Louis Saltel, Le Rheu (FR); Gwenaël Tanguy, Pace (FR); Samuel Roselier, Le Rheu (FR); Romain Neveu, Rennes (FR)

(73) Assignee: Saltel Industries (FR)

( * ) Notice: Subject to any disclaimer, the term of this patent is extended or adjusted under 35 U.S.C. 154(b) by 0 days.

(21) Appl. No.: 15/110,536

(22) PCT Filed: Jan. 9, 2015

(86) PCT No.: PCT/EP2015/050345

§ 371 (c)(1),
(2) Date: Jul. 8, 2016

(87) PCT Pub. No.: WO2015/104381

PCT Pub. Date: Jul. 16, 2015

(65) Prior Publication Data

US 2016/0341003 A1 Nov. 24, 2016

(30) Foreign Application Priority Data

Jan. 10, 2014 (FR) ..... 14 50214

(51) Int. Cl.
*E21B 33/127* (2006.01)
*E21B 34/10* (2006.01)
(Continued)

(52) U.S. Cl.
CPC ..... *E21B 34/10* (2013.01); *E21B 33/127* (2013.01); *E21B 34/063* (2013.01); *E21B 33/14* (2013.01)

(58) Field of Classification Search
CPC ..... E21B 34/10; E21B 34/063; E21B 33/127; E21B 33/14
See application file for complete search history.

(56) References Cited

U.S. PATENT DOCUMENTS 2,935,615 A 5/1960 True
6,640,893 B1 11/2003 Rummel et al.
(Continued)

FOREIGN PATENT DOCUMENTS

EP 2206879 A1 7/2010
EP 2435656 A2 4/2012
WO 2010136806 A2 12/2010

OTHER PUBLICATIONS

International Search Report for Application No. PCT/EP2015/050345 dated Mar. 25, 2015.
(Continued)

*Primary Examiner* — D. Andrews
*Assistant Examiner* — Yanick A Akaragwe
(74) *Attorney, Agent, or Firm* — Lerner, David, Littenberg, Krumholz & Mentlik, LLP

(57) ABSTRACT

The invention relates to an insulation device for wells by controlled supply of the internal volume of an expandable sleeve placed on a casing, comprising a non-return valve placed in a passage which connects the internal volumes of the casing and of the sleeve and a three-way valve which switches a single time between an initial state in which a link connects the internal volumes of the casing and of the sleeve to expand the sleeve and a final state in which the link between the internal volumes of the casing and of the sleeve is interrupted, whereas a link is set up between the internal volume of the sleeve and an annular volume of the well, the three-way valve and the non-return valve forming, after switching, two non-return valves mounted in series and in opposite directions on the passage connecting the internal volumes of the casing and of the sleeve.

18 Claims, 19 Drawing Sheets

Figure 1:
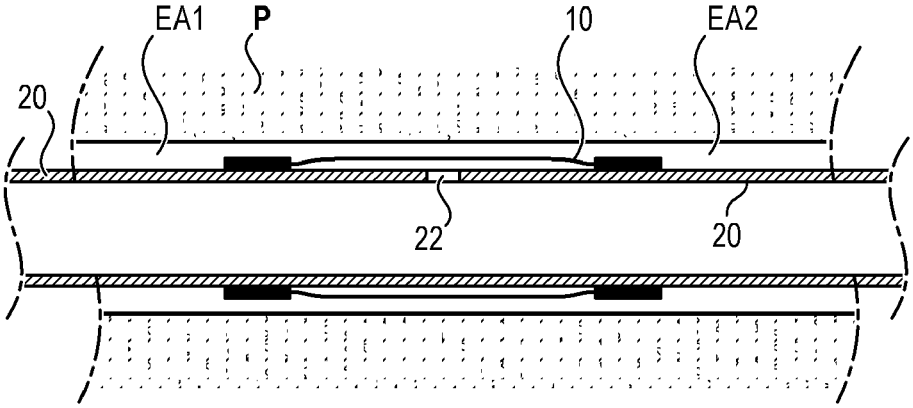
FIG. 1 Prior art

(51) Int. Cl.
*E21B 34/06* (2006.01)
*E21B 33/14* (2006.01)

(56) References Cited

U.S. PATENT DOCUMENTS

| | | | | |
|---|---|---|---|---|
| 7,077,195 | B2 * | 7/2006 | Zotta | E21D 20/02 138/93 |
| 7,306,033 | B2 | 12/2007 | Gorrara | |
| 7,571,765 | B2 | 8/2009 | Themig | |
| 7,591,321 | B2 | 9/2009 | Whitsitt et al. | |
| 2005/0023003 | A1 | 2/2005 | Echols et al. | |
| 2007/0151735 | A1 | 7/2007 | Ravensbergen et al. | |
| 2012/0125619 | A1 | 5/2012 | Wood et al. | |
| 2012/0227969 | A1 | 9/2012 | Gray | |
| 2014/0190683 | A1 * | 7/2014 | Hallunbæk et al. | E21B 33/1285 166/122 |
| 2016/0003000 | A1 * | 1/2016 | Wood | E21B 33/127 166/387 |

OTHER PUBLICATIONS

French Search Report for Application No. FR1450214 dated Sep. 11, 2014.

Dreesen, D.S. et al., "Analytical and Experimental Evaluation of Expanded Metal Packers for Well Completion Services", 1991.

* cited by examiner

INSULATION DEVICE FOR A WELL

CROSS REFERENCE TO RELATED APPLICATIONS

The present application is a national phase entry under 35 U.S.C. § 371 of International Application No. PCT/EP2015/050345 filed Jan. 9, 2015, published in French, which claims priority from French Patent Application No. 1450214, filed Jan. 10, 2014, all of which are incorporated herein by reference.

FIELD OF THE INVENTION

The present invention relates to a device for control and insulation of a tool in the form of an expandable sleeve for the treatment of a well or piping, this tool being connected to a casing for supply of pressurised fluid and is interposed between said casing and the wall of said well or of the piping.

In other words, it relates to a well base device for insulating the space upstream of the space downstream from an annular region between a casing and the formation (that is, the rock of the subsoil) or else between this same casing and the inner diameter of another casing already present in the well. This insulation must be done so as to preserve the integrity of the entire casing of the well (casing string), that is, the steel column between the formation and the wellhead.

It is evident that the integrity of the annular space and the integrity of the casing have to be distinguished, the two being essential to the integrity of the well.

The annular space cited above is generally made tight by using cement which is pumped in liquid form into the casing from the surface, then injected into the annular space. After injection, the cement hardens and the annular space is sealed.

The quality of cementing of this annular space is very important for the integrity of wells.

In fact, this sealing protects the casing of the saltwater areas enclosed by the subsoil which can corrode and damage it, causing possible loss of the well.

In addition, this cementing protects aquifers from the pollution which might be caused by close formations containing hydrocarbons.

This cementing constitutes a barrier protecting the risks of eruption caused by gases under high pressure, which can migrate into the annular space between the formation and the casing.

In practice, there are many reasons which can result in an imperfect cementing process, such as large well size, horizontal areas of the latter, difficult circulation or loss areas. Poor sealing results from this.

It is also evident that wells are deeper and deeper, that many of them are drilled "offshore" vertically to water depths reaching over 2000 m, and that recent hydraulic fracturing technologies, in which pressures can reach over 15,000 psi (1000 bars), subject these sealed annular areas to very high stresses.

From the above, it is clear that cementing of the annular space(s) is particularly important and any weakness in their manufacture, while pressures involved are very high (several hundreds of bars), can cause damage possibly resulting in loss of the well and/or cause considerable ecological damage.

These pressures can originate from:

the interior of the casing towards the exterior, that is, from the interior of the well towards the annular space;

the annular space towards the interior of the casing.

The casing (or "casing string"), whereof the length can reach several thousands of meters, comprises casing tubes of a unit length between 10 and 12 m, and assembled together by sealed threads.

The nature and thickness of the material constituting the casing is calculated to support very high internal burst pressures or external collapse pressures.

Also, the casing must be sealed throughout the service life of the well, that is, over several tens of years. Any detection of a leak systematically results in repair or by means of abandoning the well. Technical solutions are currently available to seal said annular space.

PRIOR ART

Many insulation devices have already been proposed and are currently used for this purpose.

Document U.S. Pat. No. 7,571,765 describes a device comprising a rubber ring compressed and expanded radially by a hydraulic pressure via a piston, to make contact with the wall of the well. When in use however these devices do not correctly seal a well, as they exhibit a non-cylindrical cross-section of revolution and are highly sensitive to variations in temperature.

Mechanical insulation devices based on inflatable elastomer compounds of a polymer of rubber type activated on inflation by contact with fluid (oil, water, or other according to formulations) have been proposed. To avoid blockage of the tube during descent into the well, inflating must be relatively slow and can sometimes require several weeks for insulation of the area to be effective.

Other types of insulation devices comprise a metal expandable sleeve deformed by application of pressurised liquid (see the article SPE 22 858 "Analytical and Experimental Evaluation of Expanded Metal Packers For Well Completion Services" (D. S. Dreesen et al—1991), U.S. Pat. Nos. 6,640,893, 7,306,033, 7,591,321, EP 2 206 879, EP 2 435 656).

Figure 2:
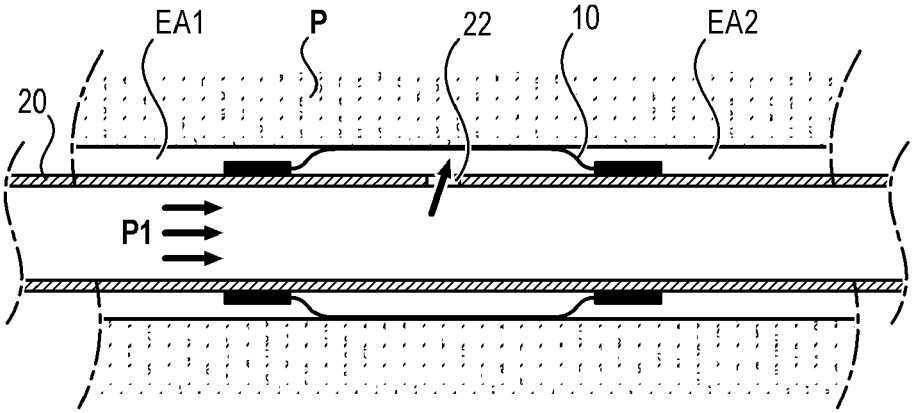
FIG. 2 Prior art

The appended FIGS. 1 and 2 illustrate the general structure of a known system of this type.

As is evident in FIG. 1, to create an insulation device annular intended to insulate in a sealed manner two adjacent annular spaces, referenced EA1 and EA2, of a well or formation whereof the wall is referenced P, a known technique consists of positioning a deformable ductile membrane 10 of cylindrical geometry around a casing 20, at the desired placement.

The membrane 10 is attached and sealed at its ends on the surface of the casing 20. A sleeve in the form of a ring is consequently defined between the external surface of the casing 20 and the inner surface of the membrane 20. The interior of the casing 20 and the internal volume of the sleeve formed by the membrane 20 communicate with each other via a passage 22 which passes through the wall of the casing 20.

The membrane 10 is then expanded radially towards the exterior until it is in contact with the wall P of the well, as in FIG. 2, by increasing the pressure P1 in the casing 20. The membrane 10 creates sealing on this wall P and the two annular spaces EA1 and EA2 defined between the wall P of the formation and the wall of the casing 20 are then insulated.

The membrane 10 can be metal or elastomer, reinforced or not by fibres.

Although already the subject of much research, the devices of the type illustrated in appended FIGS. 1 and 2 present several disadvantages.

If the membrane 10 is made of elastomer and circulation of the inflation fluid is without valve in the passage 22, the membrane assumes a form near its initial state, if the pressure is relaxed inside the casing, after having inflated it. The membrane 10 no longer acts as insulation of the annular space.

If the membrane 10 is metal and circulation of the inflation fluid between the interior of the membrane 10 and the interior of the casing 20 is done directly, once deformed permanently, the membrane 10 in principle retains its form and its barrier function in the annular space is also retained when the pressure in the casing 20 is relaxed. However if the pressure in the annular space rises, for example, from EA1, the pressure differential between EA1 and the interior of the membrane 10 can be sufficient to collapse the metal membrane 10 and it no longer has its role of insulating the annular space.

To avoid this, in the case of a metal or elastomer membrane 10, the orifice 22 enabling circulation of the inflation fluid between the interior of the casing 20 and the interior of the membrane 10 can be provided with a non-return valve. This valve traps the pressurised inflation volume inside the membrane 10 on completion of inflation. However if the temperature and/or the pressure in the annular space evolve, the volume inside the membrane can also evolve. If the pressure drops, the membrane 10 can collapse or lose its sealing contact with the wall P of the well. The insulation function of the annular space is no longer ensured. If however the pressure rises, the membrane 10 can deform and rupture. If the membrane 10 does not rupture, there is the risk that the pressure rises sufficiently inside the membrane 10 to collapse the wall of the casing 20.

To avoid this risk, for example in documents WO 2010/136806 and US20120125619, in addition to the first orifice 22 fitted with a non-return valve, a second orifice has been proposed, provided in between the membrane 10 and the high-pressure area EA1 which integrates a rupture disc. The latter creates an opening between the interior of the membrane 10 and the high-pressure area EA1 on completion of inflation. In this way, the evolutions of the temperature of the well or of the pressure from EA1 have no more effect on the pressure inside the membrane 10 since the membrane 10 is in communication with the annular space. However if the pressure rises later in the casing 20, the non-return valve provided in the passage 22 lets through fluid from the casing 20 towards the membrane 10 and from the membrane 10 directly into the annular space.

In replacing the above rupture disc, document WO 2010/136806 also provides a second orifice between the membrane 10 and the casing 20 with a soupape valve type which allows evacuating any overpressure from the metal membrane 10. This solution suits when the volume and the pressure inside the membrane 10 increase. But if the volume trapped in the membrane 10 diminishes, the risk of collapsing the membrane 10 or losing contact between the membrane 10 and the wall P of the well persists.

AIM OF THE INVENTION

The aim of the invention is to propose a device which resolves the above problems.

This aim is attained according to the invention by an insulation device for treatment of a well, comprising an expandable sleeve placed on a casing and an assembly adapted to control the supply of the internal volume of the sleeve by means of pressurised fluid coming from the casing, via a passage passing through the wall of the casing, to expand the sleeve radially towards the exterior, characterized in that said assembly comprises a non-return valve placed in a passage which connects the internal volume of the casing to the internal volume of the sleeve and means forming a three-way valve adapted to be switched a single time between an initial state in which a link is set up between the internal volume of the casing and the internal volume of the sleeve to expand said sleeve and a final state in which the link between the internal volume of the casing and the internal volume of the sleeve is interrupted and a link is set up between the internal volume of the sleeve and an annular volume of the well external to sleeve and the casing, said three-way valve and said non-return valve forming, after switching, two valves mounted in series and in opposite directions on the passage connecting the internal volumes of the casing and of the sleeve.

According to another advantageous characteristic of the present invention, the means forming a three-way valve define a temporary intermediate state which occurs between the initial state and the final state and in which the link between the internal volume of the casing and the internal volume of the sleeve is interrupted, but the link between the internal volume of the sleeve and the annular volume of the well external to sleeve and the casing is not yet set up.

According to a first variant embodiment, the non-return valve placed in the passage which connects the internal volume of the casing to the internal volume of the sleeve is a valve stressed elastically on closing, which opens under fluid pressure which acts in the direction going from the internal volume of the casing towards the internal volume of the sleeve.

According to a second variant embodiment, the non-return valve placed in the passage which connects the internal volume of the casing to the internal volume of the sleeve is a valve stressed elastically on closing, which opens under fluid pressure which acts in the direction going from the internal volume of the sleeve towards the internal volume of the casing, said valve being held initially in the open position by temporary means, for example a retaining element likely to rupture and/or degrade.

According to another advantageous characteristic of the present invention, the valves are non-return valves in which a metal stopper rests on a preferably conical metal seat.

According to another characteristic advantageous of the present invention, the non-return valve placed in the passage which connects the internal volume of the casing to the internal volume of the sleeve and the three-way valve are formed from separate two sub-assemblies, for example placed in separate parallel longitudinal channels formed in the body of the assembly.

According to another advantageous characteristic of the present invention, the means which control closing of the communication between the internal volume of the casing and the internal volume of the sleeve comprise a retaining element likely to rupture or an retaining element likely to degrade or a combination of a first retaining element which must break with a second retaining element which must degrade.

According to an advantageous embodiment the three-way valve comprises a body which defines a chamber in which terminate communication conduits respectively with the interior of the casing, the interior of the expandable sleeve and the annular space located outside the casing, a piston mounted in translation in said chamber and releasable, frangible and/or degradable immobilisation means, which initially immobilise the piston in an initial position such that the piston enables communication only between the associated conduits inside the casing and inside the expandable sleeve, then release the piston such that the piston occupies a final position in which it enables communication between the associated conduits inside the expandable sleeve and by means of an annular space located outside the casing and prohibits any renewed switching towards the initial position when the piston has reached the final position.

According to another advantageous characteristic of the present invention, the piston and the releasable immobilisation means define a temporary intermediate position between the initial position and the final position, in which the three communication conduits associated respectively with the interior of the casing, the interior of the expandable sleeve and the annular space located outside the casing are insulated from each other.

The invention also relates as such to the above assemblies comprising in combination a non-return valve and a three-way valve, after switching forming two valves mounted in series and in opposite directions.

The invention also relates to an insulation method of two annular areas of a well, performing a supply step of an expandable sleeve placed on a casing by means of pressurised fluid coming from the casing to expand the sleeve radially towards the exterior, characterized in that it comprises the steps consisting of supplying the internal volume of the expandable sleeve by means of a non-return valve placed in a passage which connects the internal volume of the casing to the internal volume of the sleeve then performing switching of a three-way valve between an initial state in which a link is set up between the internal volume of the casing and the internal volume of the sleeve to expand said sleeve and a final state in which the link between the internal volume of the casing and the internal volume of the sleeve is interrupted and a link is set up between the internal volume of the sleeve and an annular volume of the external well to sleeve and to casing, said three-way valve and said non-return valve forming, after switching, two valves mounted in series and in opposite directions on the passage connecting the internal volumes of the casing and of the sleeve.

PRESENTATION OF FIGURES

Figure 3:
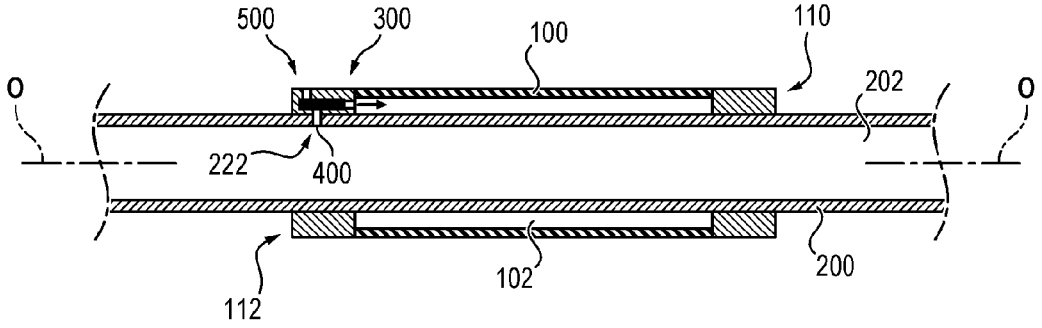
Figure 4:
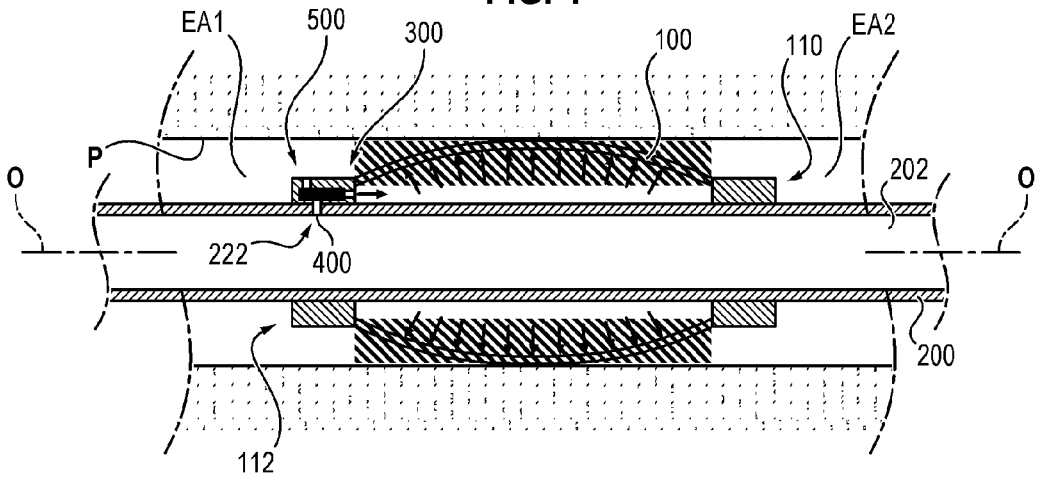
Figure 5:
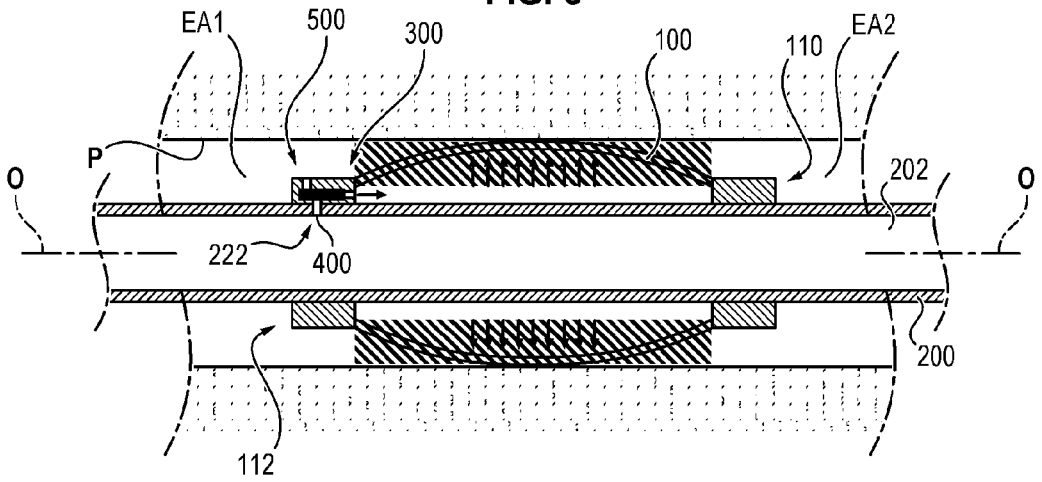
Figure 6:
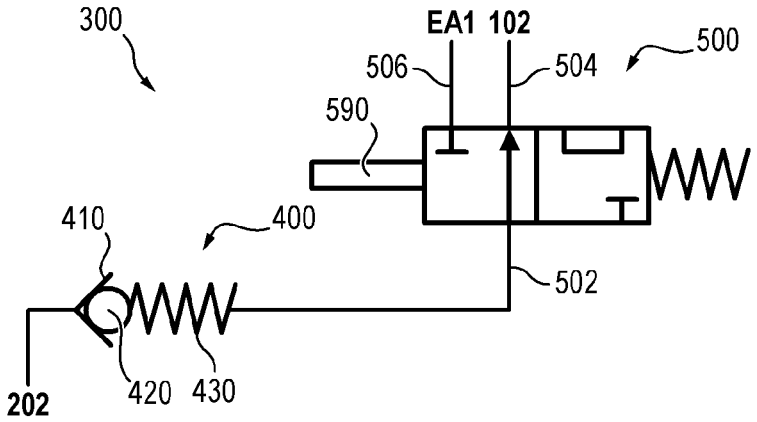
Figure 7:
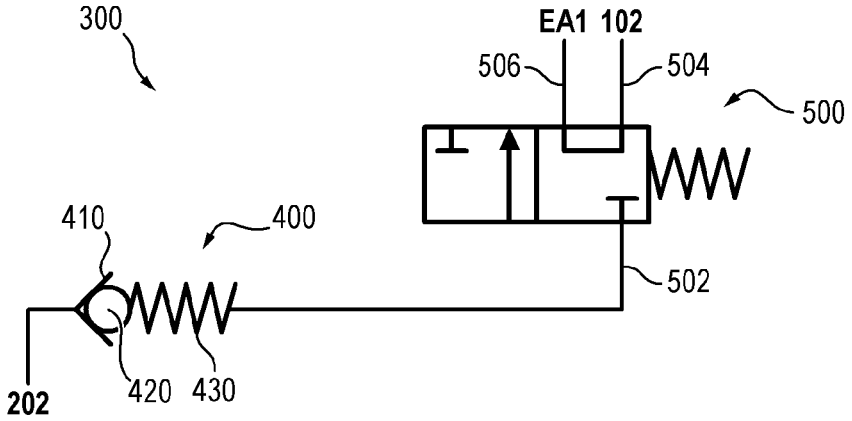
Figure 8:
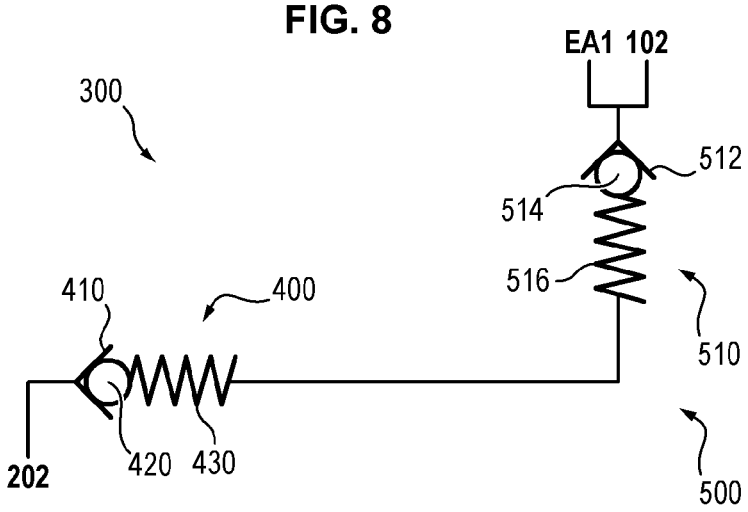
Figure 9:
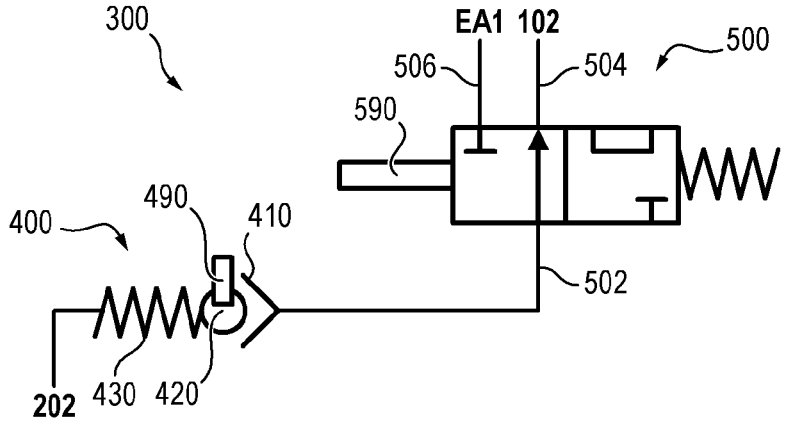
Figure 10:
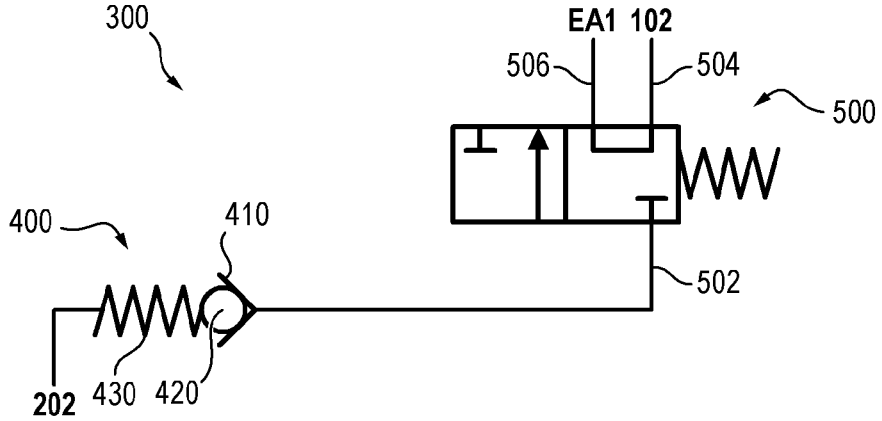
Figure 11:
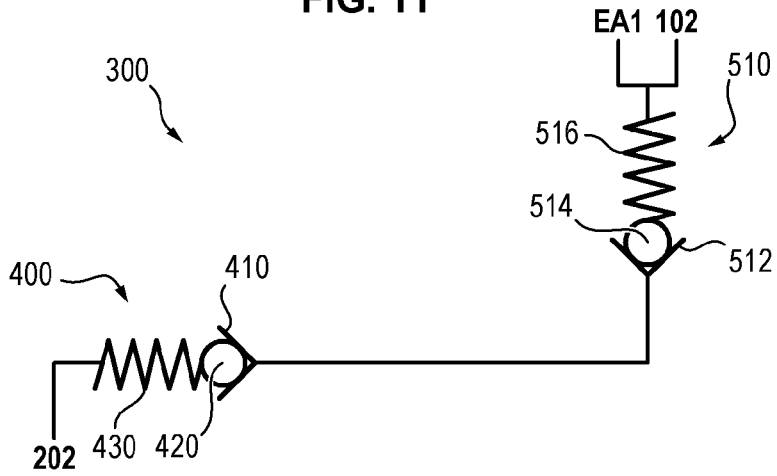
Figure 12:
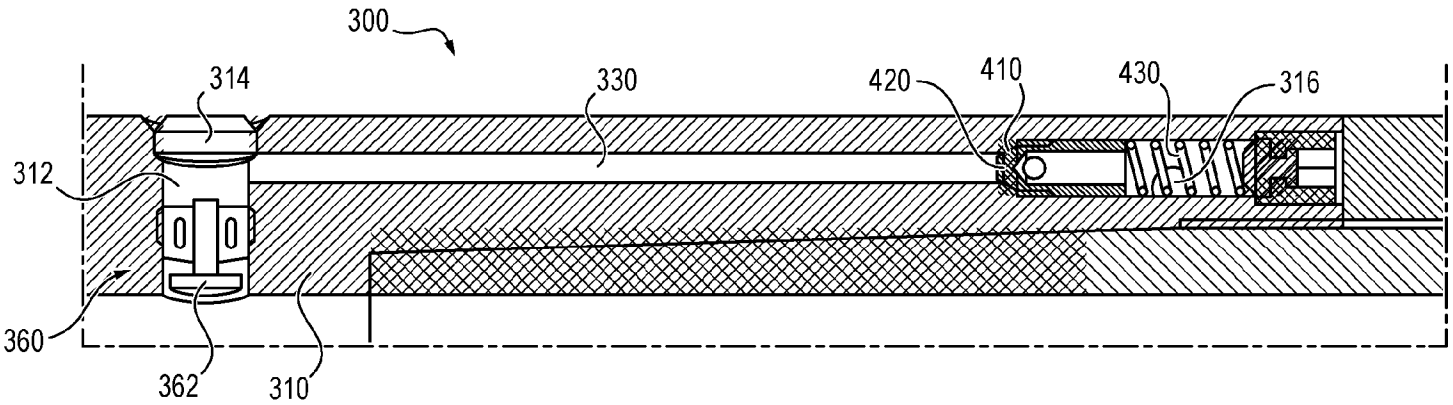
Figure 13:
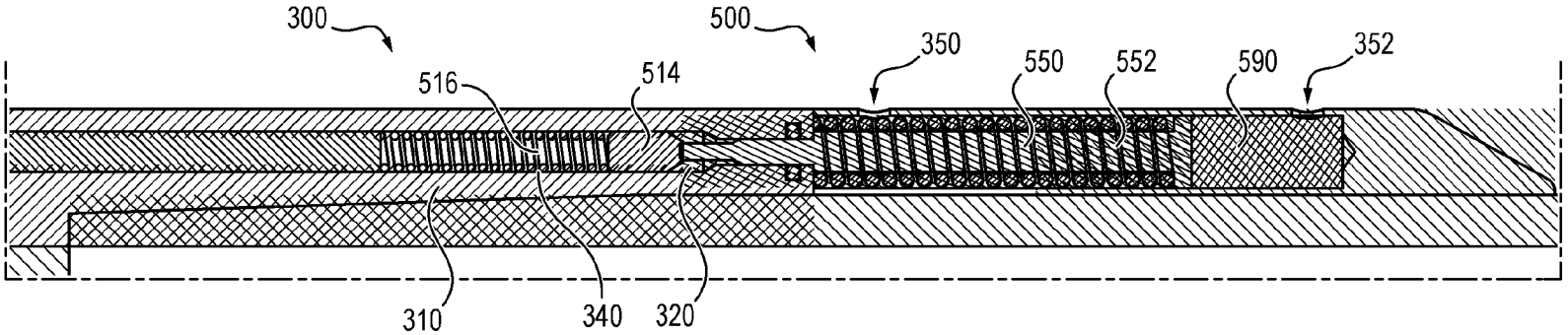
Figure 14:
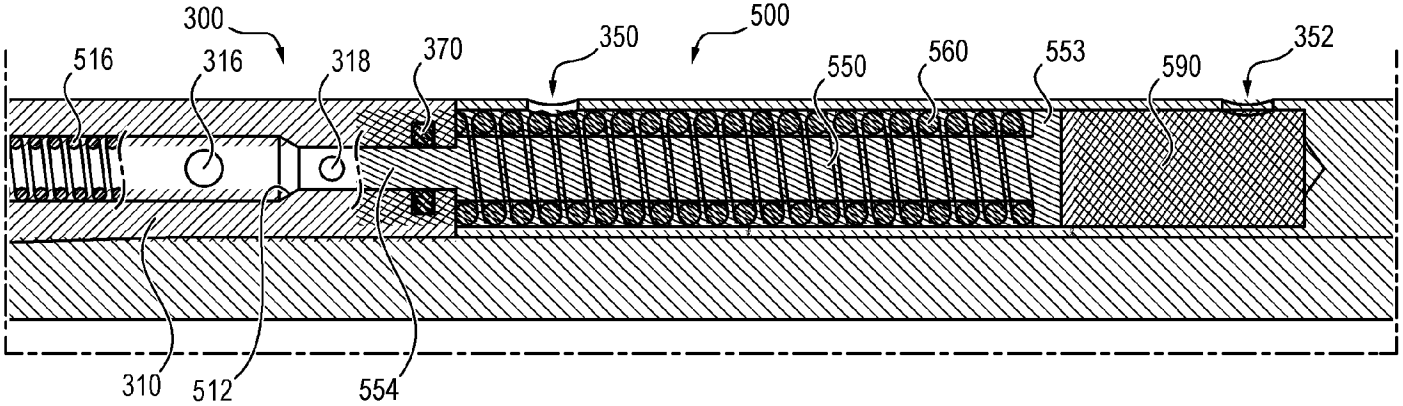
Figure 15:
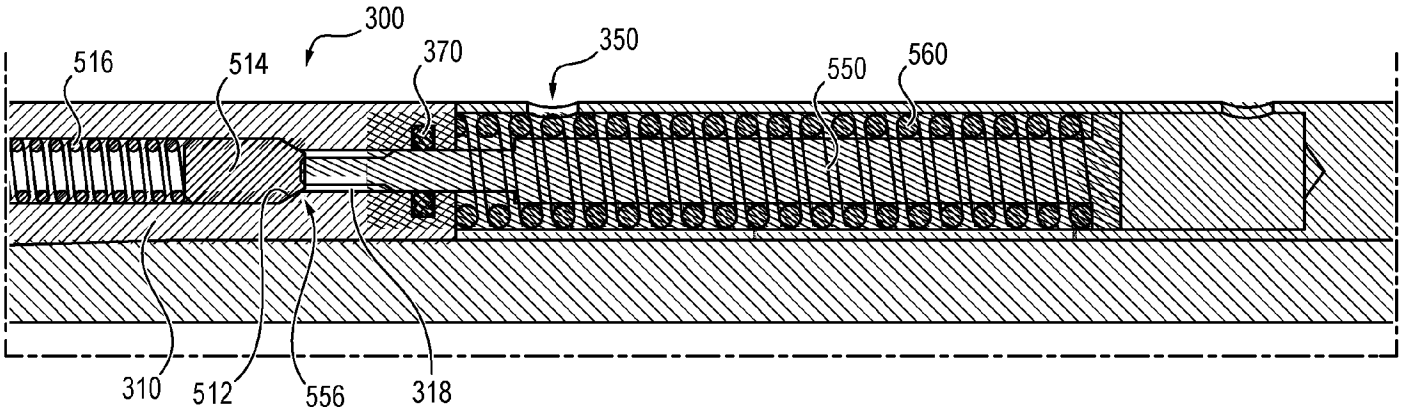
Figure 16:
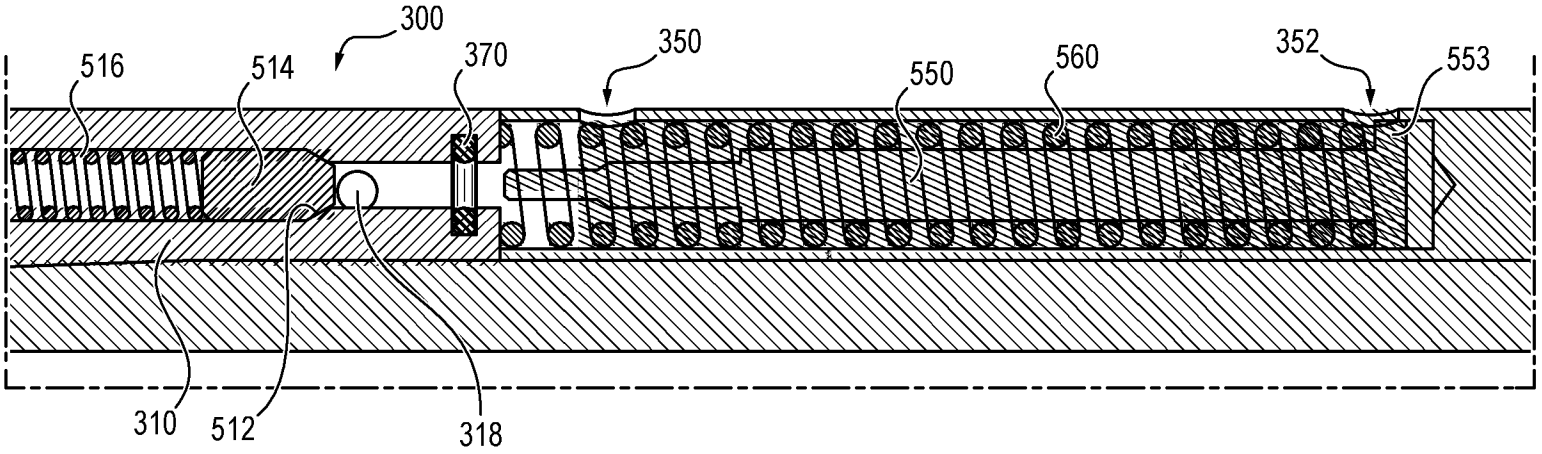
Figure 17:
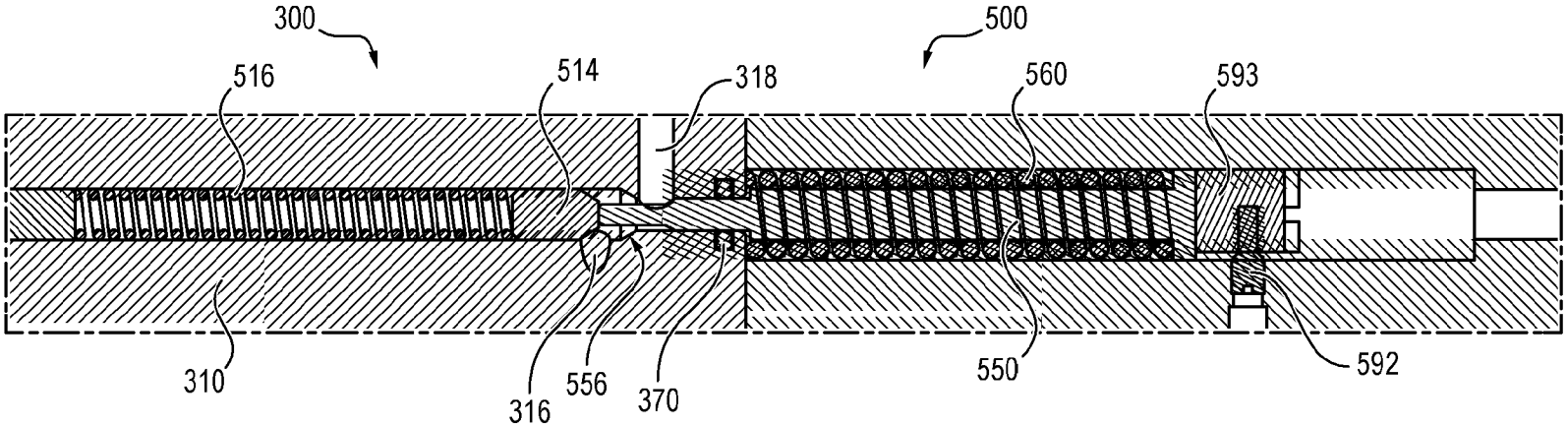
Figure 18:
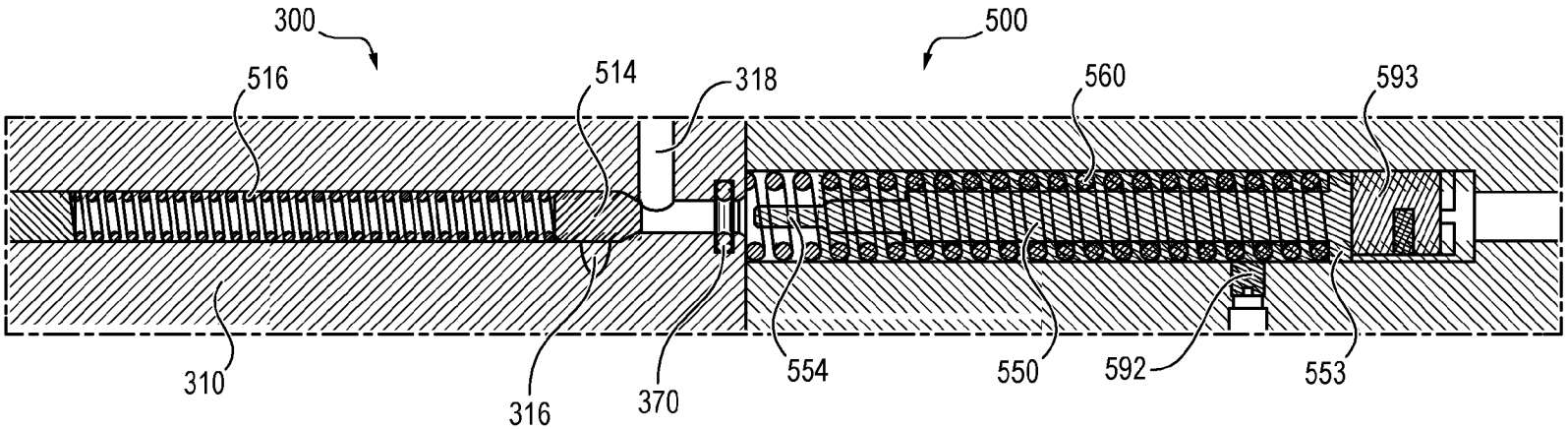
Figure 19:
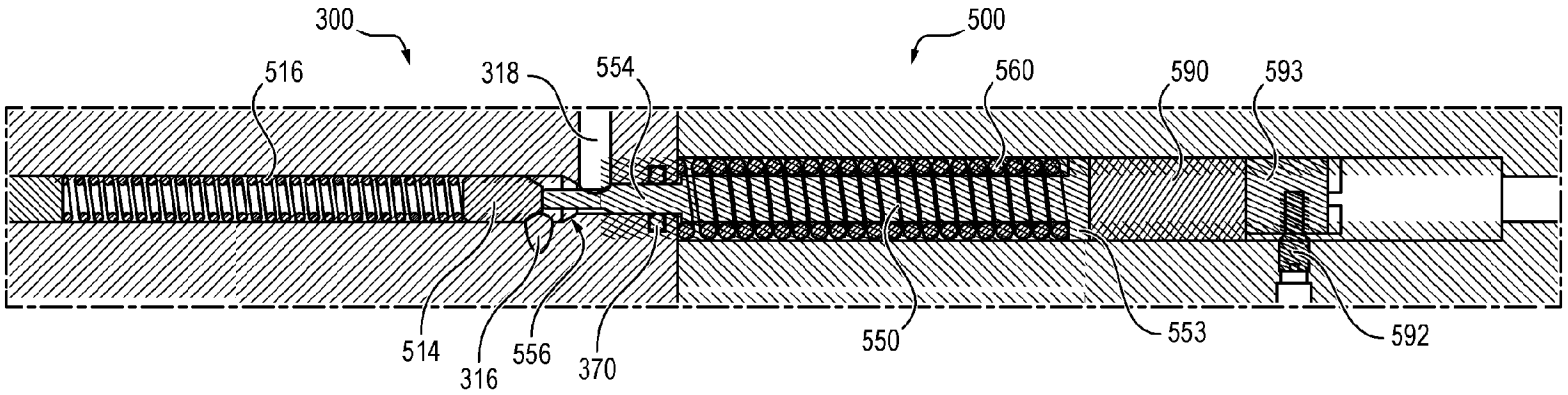
Figure 20:
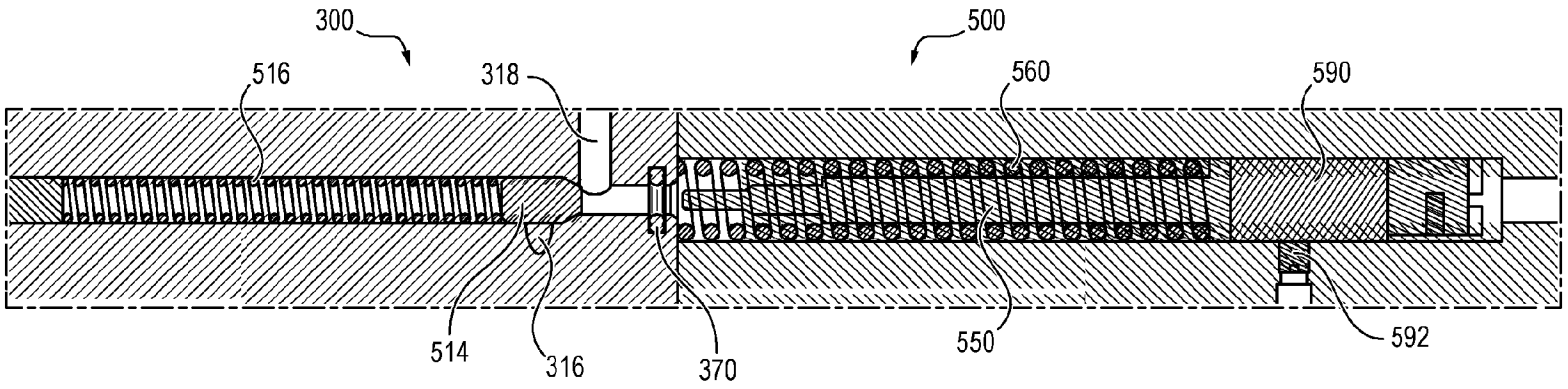
Figure 21:
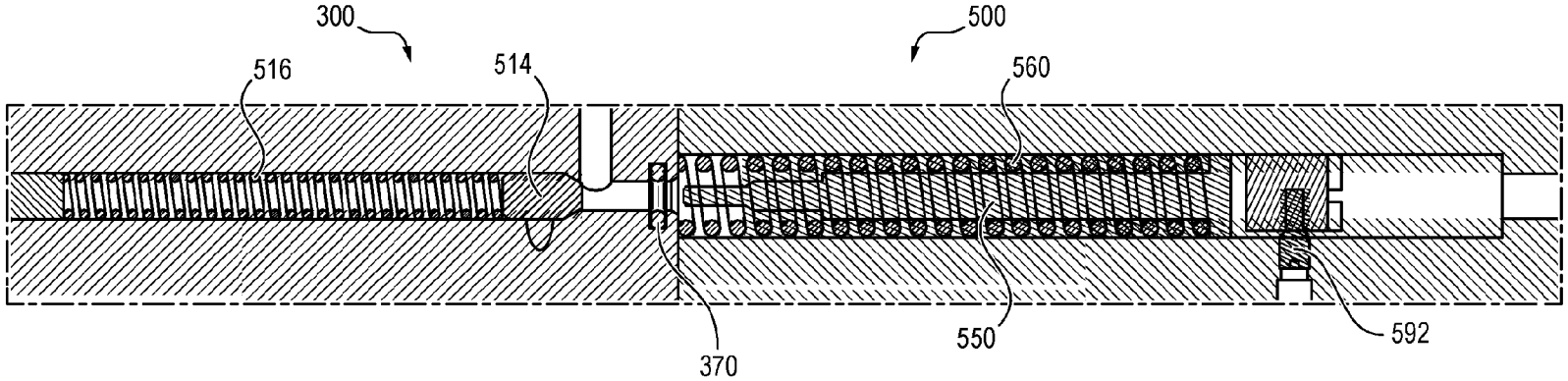
Figure 22:
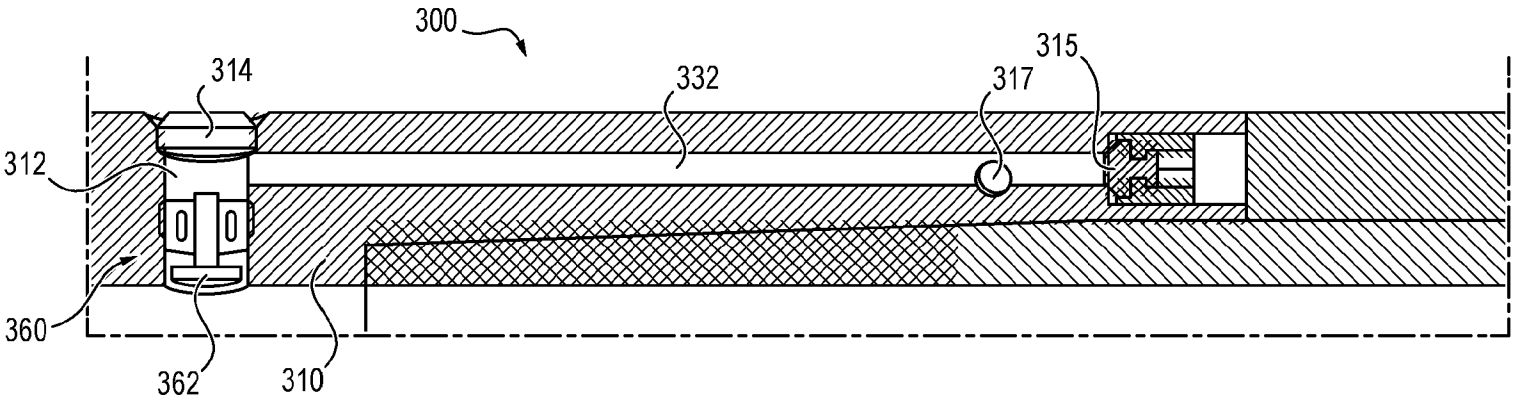
Figure 23:
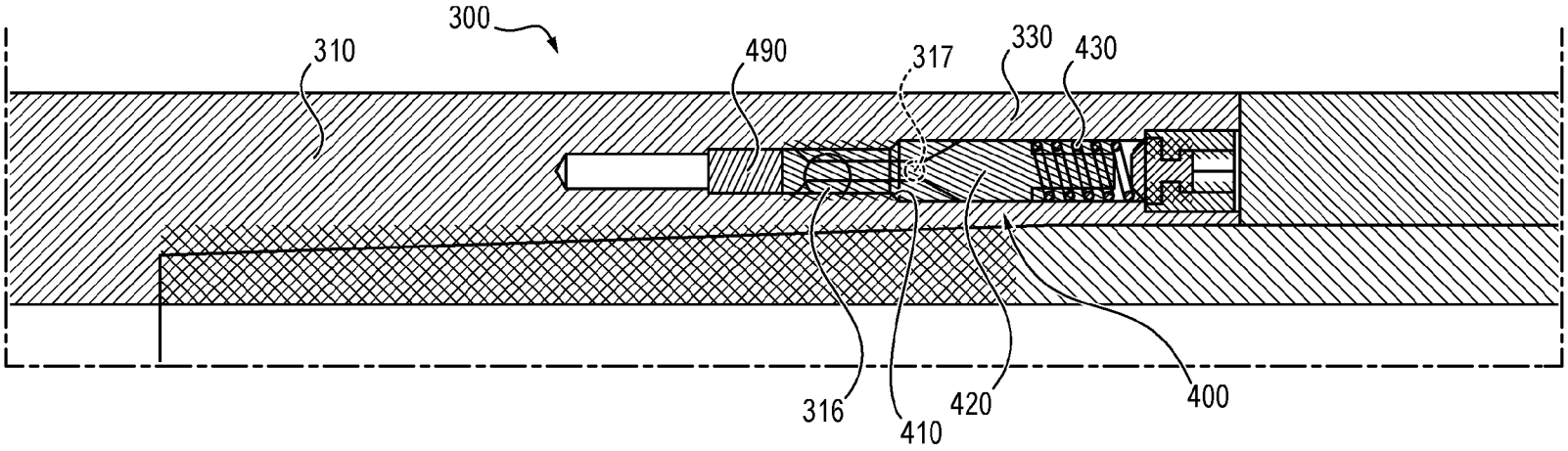
Figure 24:
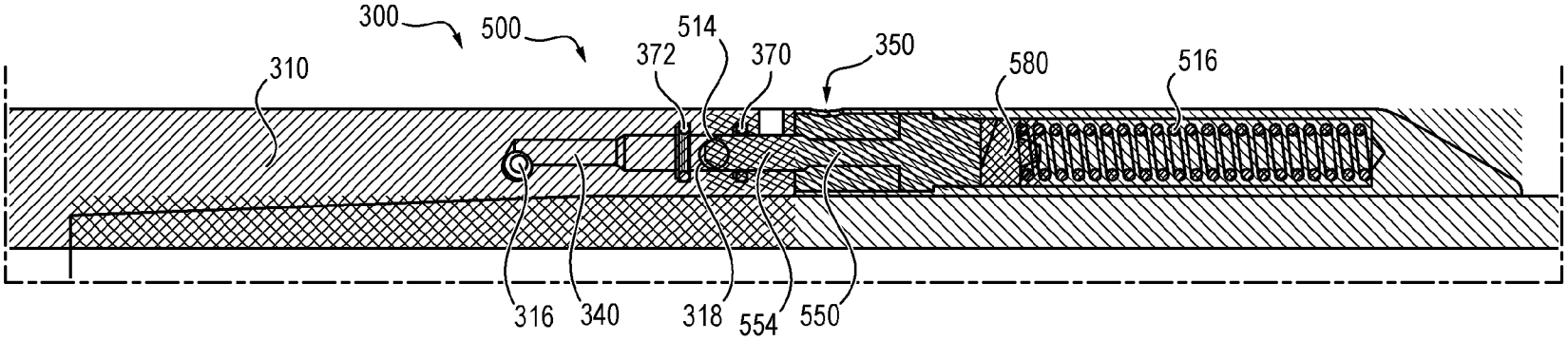
Figure 25:
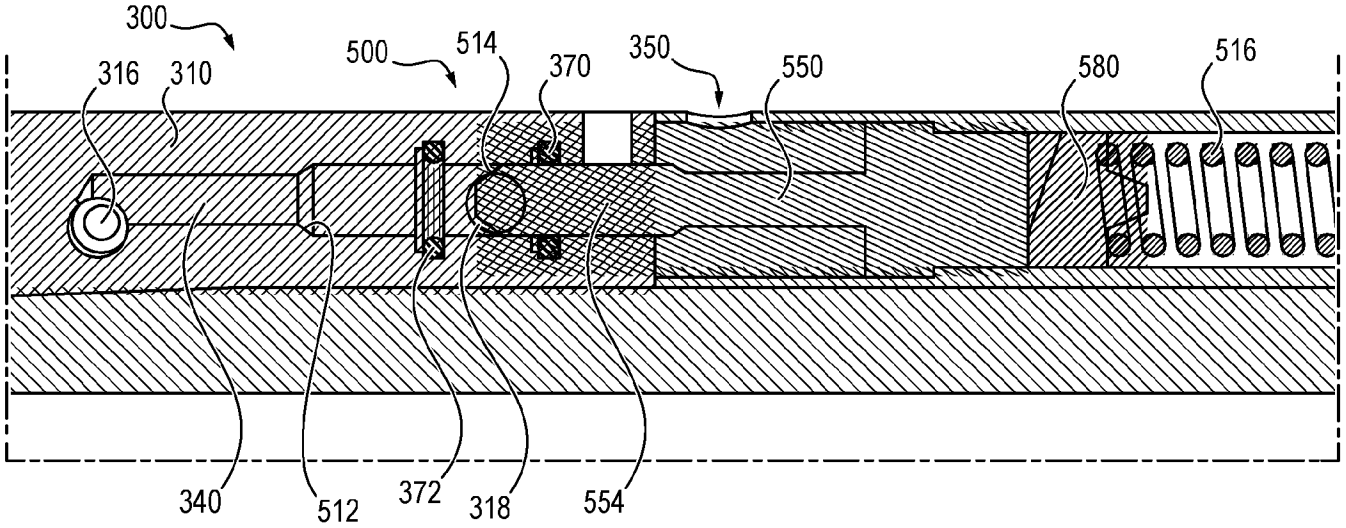
Figure 26:
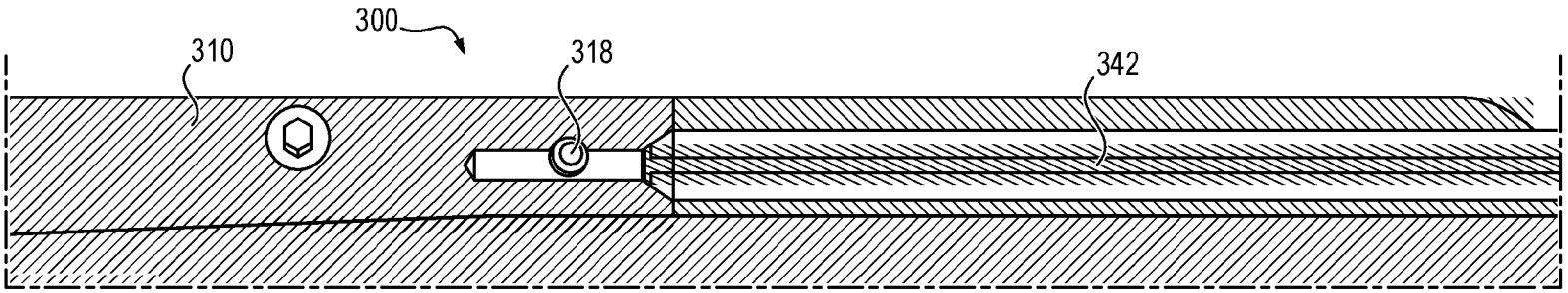
Figure 27:
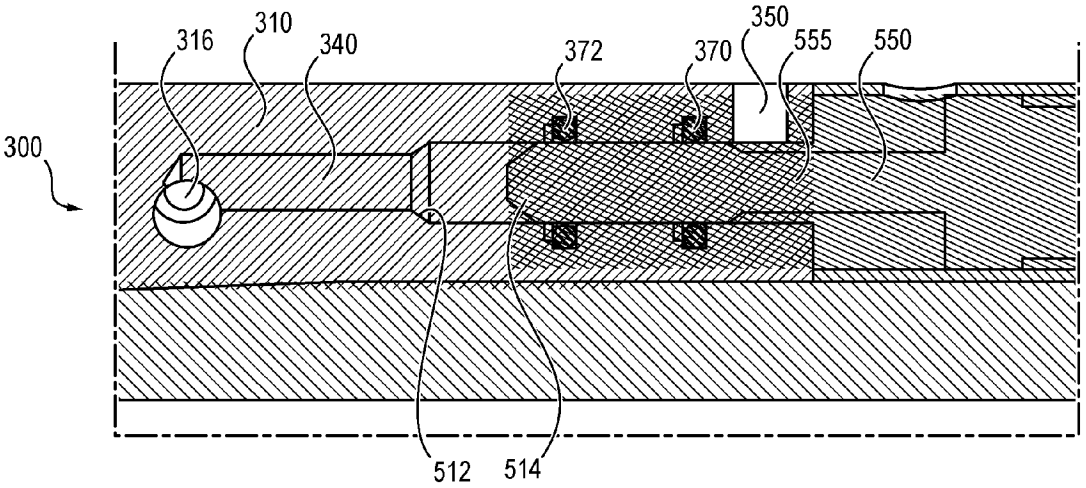
Figure 28:
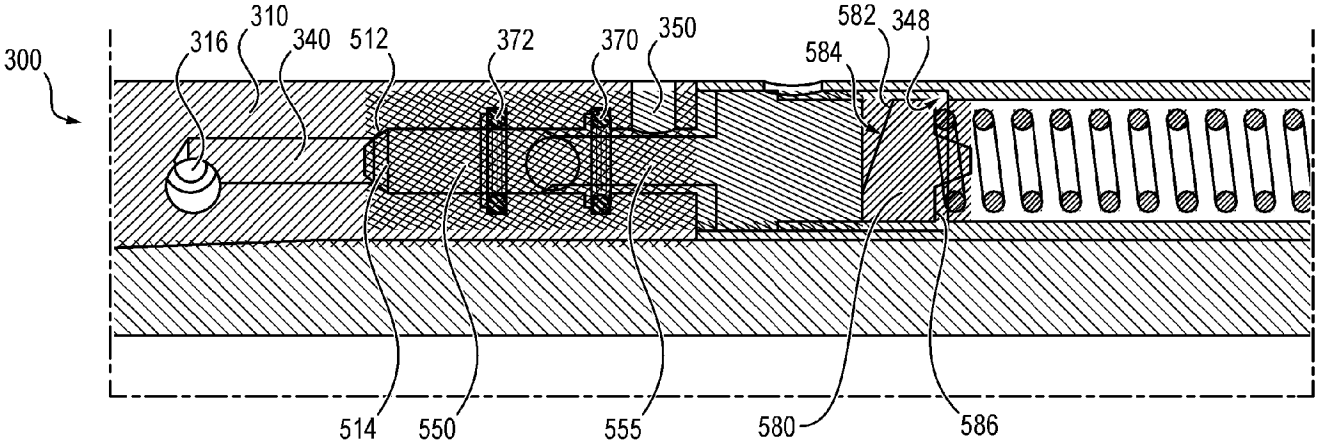
Figure 29:
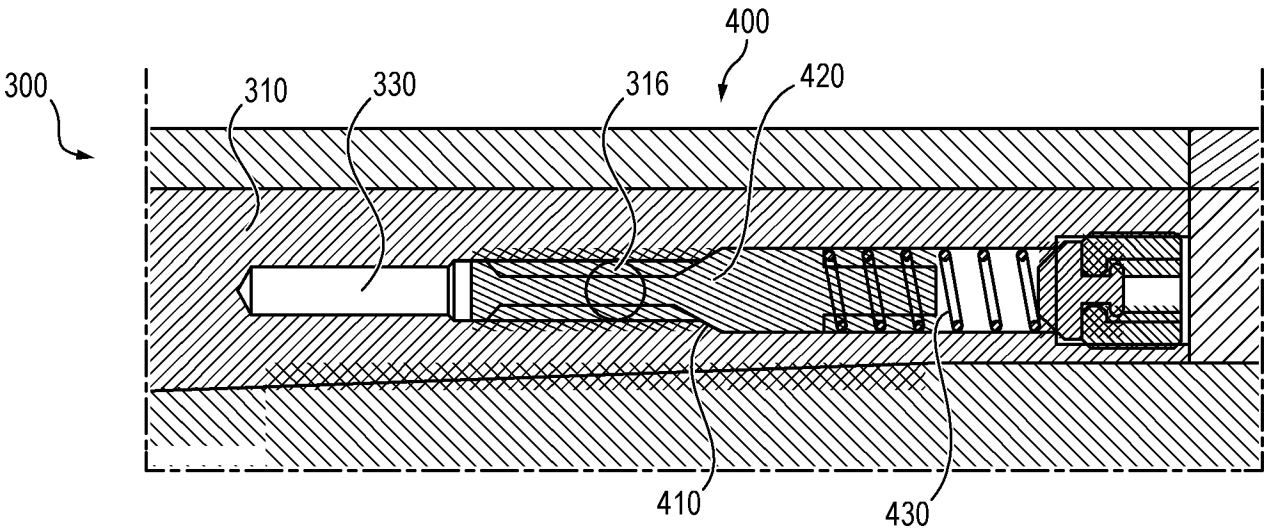
Figure 30:
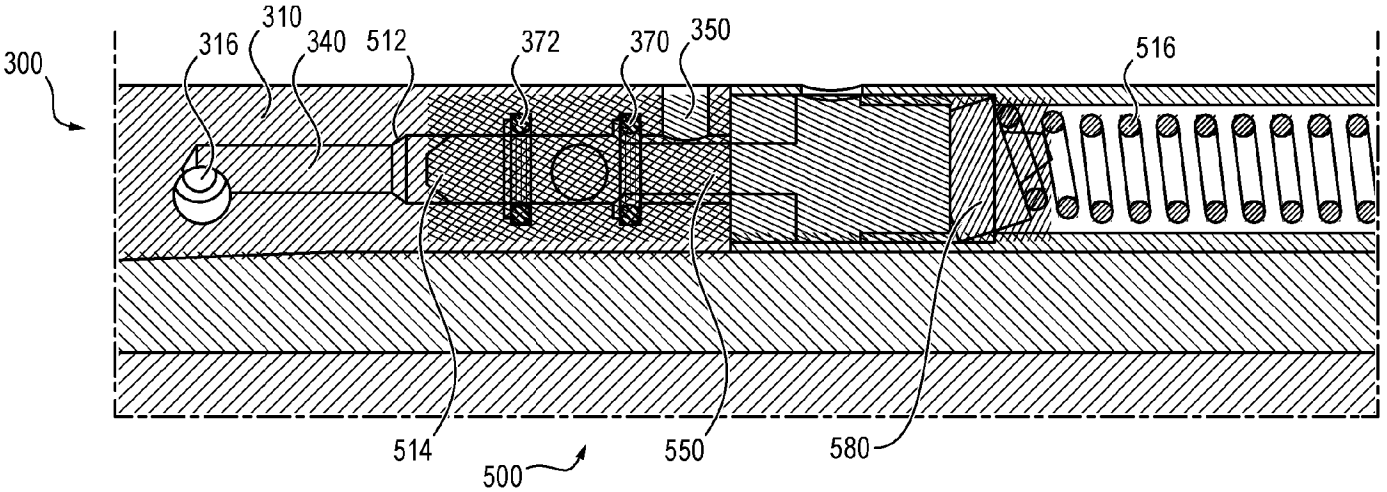
Figure 31:
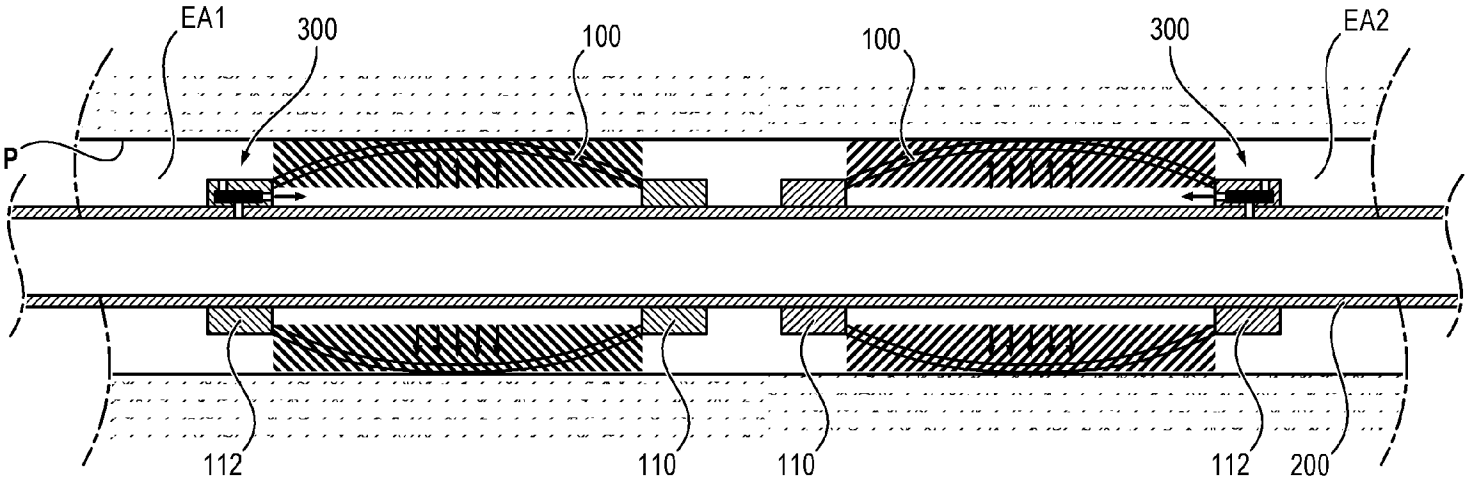
Figure 32:
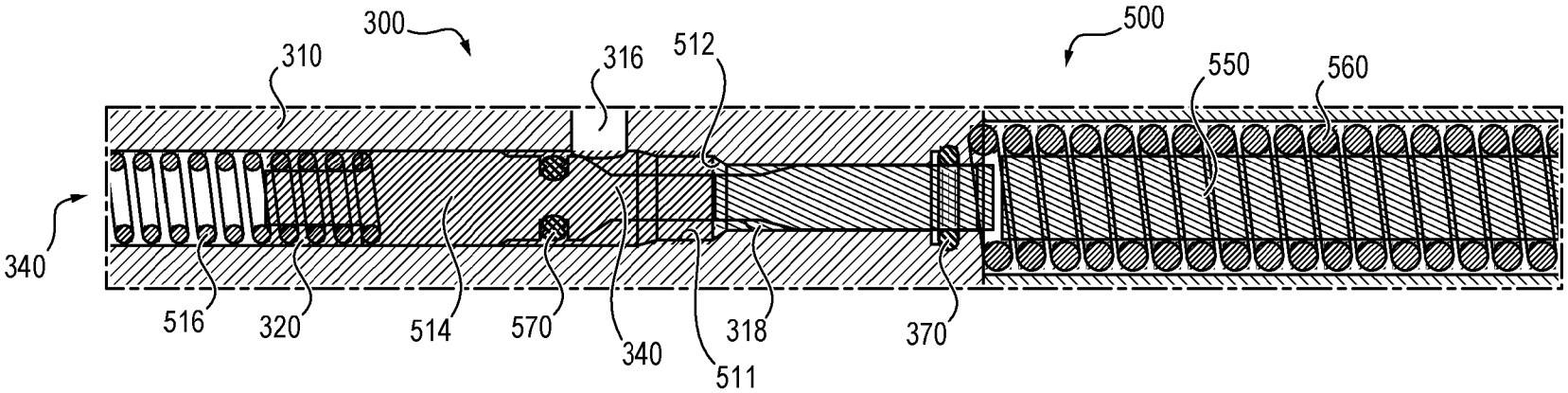
Figure 33:
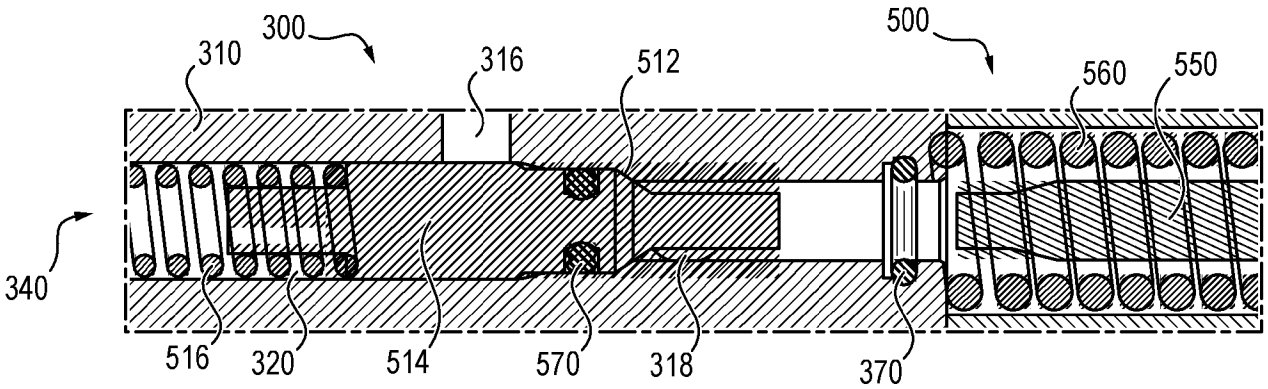
Figure 34:
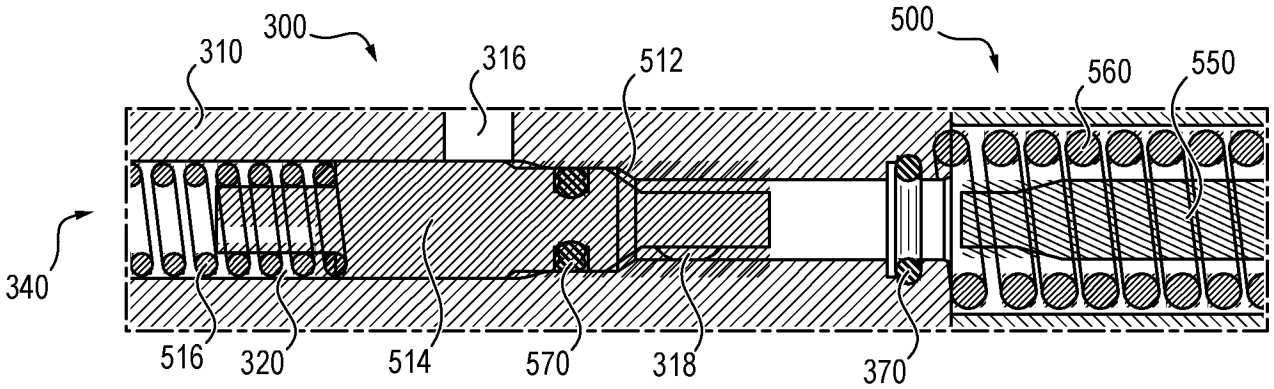
Figure 35:
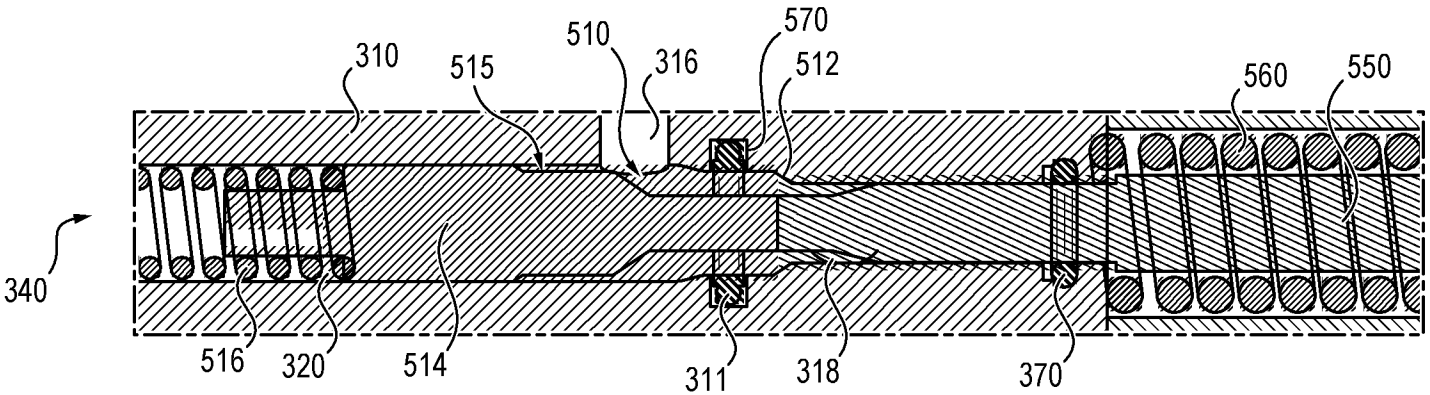
Figure 36:
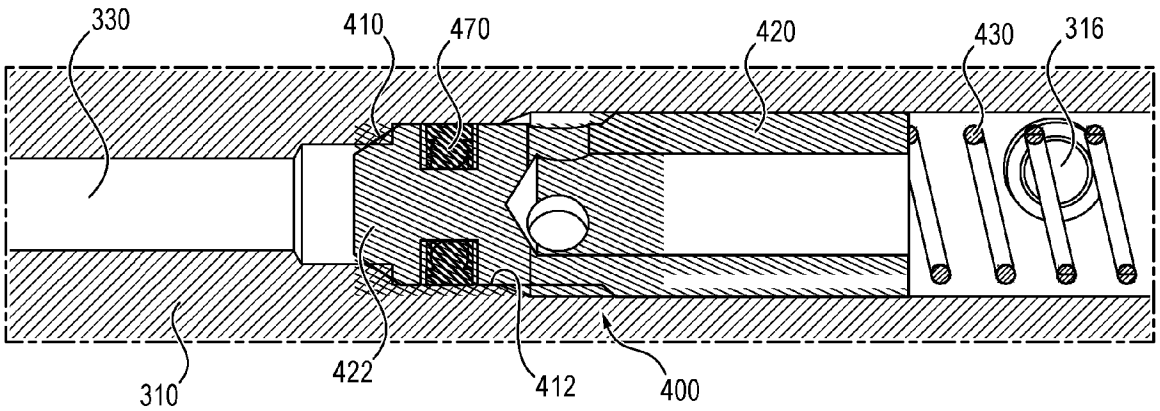
Figure 37:
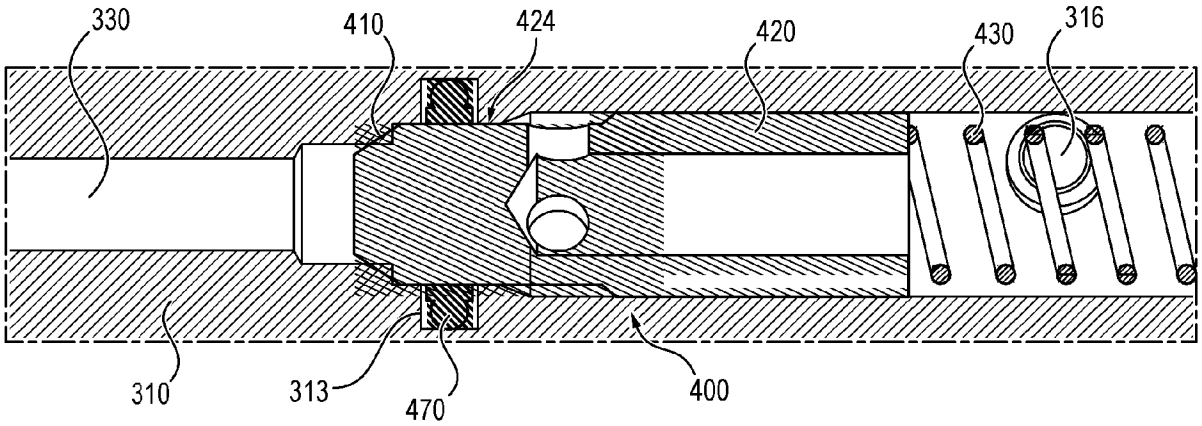

Other characteristics, aims and advantages of the present invention will emerge from the following detailed description and with respect to the appended drawings, given by way of non-limiting examples and in which:

FIGS. 1 and 2 previously described illustrate an annular insulation device according to the prior art, respectively before and after expansion of the expandable sleeve, FIGS. 3, 4 and 5 illustrate a device according to the present invention respectively in the initial state, in expansion phase of the expandable sleeve by communication between the internal volume of the casing and the internal volume of the sleeve, then in the final sealing state after switching of the three-way valve ensuring the link between the internal volume of the sleeve and the annular volume of the external well to sleeve and to casing, FIGS. 6 and 7 schematically illustrate an assembly according to a first variant embodiment of the present invention comprising in combination a three-way valve and a non-return valve at input, respectively in initial position and in final switched position, FIG. 8 illustrates the equivalent drawing of the switched assembly illustrated in FIG. 7, FIGS. 9 and 10 schematically illustrate an assembly according to a second variant embodiment of the present invention comprising in combination a three-way valve and a non-return valve at input, respectively in initial position and in final switched position, FIG. 11 illustrates the schema equivalent of the switched assembly illustrated in FIG. 10, FIGS. 12 to 16 illustrate a first embodiment of an assembly according to the present invention comprising a valve held initially by a degradable pin and in the switched state comprising two opposite valves back-to-back, FIG. 12 illustrating a view in axial section passing through a channel which houses an inlet valve, FIG. 13 illustrating a three-way valve in the initial linking state of the casing and of the sleeve, according to a view in axial section passing through a second radial plane and a channel which houses the three-way valve, FIG. 14 illustrating an enlarged view of FIG. 13 and a piston partially dismantled to show the location of conduits coming from the internal volume of the casing and respectively going towards the internal volume of the sleeve, FIG. 15 illustrating the three-way valve in its intermediate state according to which the three ways of the valve are isolated and FIG. 16 illustrating the three-way valve in its final switched state in which the internal volume of the sleeve is connected to the annular volume of the well, FIGS. 17 and 18 illustrate views corresponding respectively to FIGS. 13 and 16 of a second embodiment of an assembly according to the present invention comprising a valve held initially by a rupture pin and in the switched state comprising two opposite valves back-to-back, FIGS. 19, 20 and 21 illustrate a third embodiment of an assembly according to the present invention comprising a valve held initially by the combination of a degradable pin and a rupture pin and in the switched state comprising two opposite valves back-to-back, more precisely FIG. 19 illustrates the valve in the initial state, FIG. 20 illustrates the valve after rupture of the rupture pin and FIG. 21 illustrates the valve after degradation of the degradable pin in case of deficiency of the rupture pin, FIGS. 22 to 30 illustrate a fourth embodiment of an assembly according to the present invention comprising a inlet valve stressed on closing but held initially in the open position by a degradable pin and/or rupture pin and a valve held initially by a degradable pin and/or rupture pin and in the switched state forming two opposite valves face-to-face, FIG. 22 illustrating a view in axial section passing through a first longitudinal inlet channel, FIG. 23 illustrating a view in axial section in a second radial plane which passes through a second longitudinal channel which houses an inlet valve in its initial open state, FIG. 24 illustrating a three-way valve in the initial linking state of the casing and of the sleeve, according to a view in axial section passing through a third radial plane and a channel which houses the three-way valve, FIG. 25 illustrating an enlarged view of FIG. 24, FIG. 26 illustrating a view in axial section of an outlet channel in a fourth radial plane, FIG. 27 illustrating the three-way valve in its intermediate transition state according to which the three ways of the valve are isolated, according to a sectional plane identical to FIG. 25, FIG. 28 illustrating the three-way valve in its final switched state, FIG. 29 illustrating the inlet valve in closed position according to a sectional plane identical to FIG. 23 and FIG. 30 illustrating the sealing function ensured by an additional ring in case of accidental leak of the inlet valve, FIG. 31 illustrates head-to-tail mounting of two insulation devices according to the invention, on a casing, to ensure insulation between two adjacent annular areas of a well, irrespective the relative evolutions of pressure in these two annular areas, FIGS. 32 to 34 illustrate a valve variant integrating additional sealing means, formed by a ring, as a complement to a stopper cooperating with a complementary conical seat, FIG. 32 illustrating this valve in open rest position, FIG. 33 illustrating this valve in closed position and FIG. 34 illustrating the valve in slightly detached position of the stopper relative to its complementary seat, sealing being ensured by the above ring, and FIGS. 35, 36 and 37 illustrate three variant embodiments of such a valve equipped with an additional sealing ring.

DETAILED DESCRIPTION OF THE INVENTION

The appended FIG. 3 shows an insulation device according to the present invention comprising an expandable sleeve 100 placed on a casing 200, facing a passage 222 passing through the wall of the casing 200 and an assembly 300 adapted to control expansion of the sleeve 100. The assembly 300 comprises a non-return inlet valve 400 and a three-way valve 500 adapted to be switched a single time and formed, after switching, in combination with the inlet valve 400, two non-return valves mounted in series and in opposite directions on a passage connecting the internal volume 202 of the casing 200 and the internal volume 102 of the sleeve 100.

The sleeve 100 is advantageously formed by a metal envelope cylindrical in revolution engaged on the exterior of the casing 200 and whereof the two axial ends 110, 112 are connected in a sealed manner to the external surface of the casing 200 at the level of these two axial ends 110 and 112.

Once the insulation device formed in this way is introduced to a well P such that the sleeve 100 is placed between two areas EA1 and EA2 to be insulated, the assembly 300 is adapted to initially ensure supply of the internal volume 102 of the sleeve 100 by means of pressurised fluid coming from the casing 200, via the passage 222 passing through the wall of the casing 200, to expand the sleeve 100 radially towards the exterior, as is evident in FIG. 4.

More precisely according to the invention, said assembly 300 comprises a non-return valve 400 placed in the passage 222 which connects the internal volume 202 of the casing 200 to the internal volume 102 of the sleeve 100 and means 500 forming a three-way valve adapted to be switched a single time between an initial state corresponding to FIG. 4, in which a link is set up between the internal volume 202 of the casing 200 and the internal volume 102 of the sleeve 100 to expand said sleeve 100 and a final state corresponding to FIG. 5, in which the link between the internal volume 202 of the casing 200 and the internal volume 102 of the sleeve 100 is interrupted, whereas a link is set up between the internal volume 102 of the sleeve 100 and an annular volume EA1 of the well P external to sleeve 100 and the casing 200, to prevent the membrane comprising the sleeve 100 from collapsing, especially under the pressure of the annular volume EA1. In fact since the internal volume 102 of the sleeve 100 is subjected to the same pressure as the annular volume EA1, the sleeve 100 is not a tributary of any evolutions in pressure in the annular volume EA1.

Preferably, as indicated previously, the valve 500 defines a temporary intermediate state between the initial state and the final state, in which no link is set up between the internal volume 202 of the casing 200, the internal volume 102 of the sleeve 100 and the annular volume EA1.

FIG. 6 shows an assembly 300 according to a first variant embodiment of the present invention comprising in combination a three-way valve 500 with two positions and a non-return valve 400 at input.

The non-return valve 400 is placed in a conduit coming from the internal volume 202 of the casing 200 and leading to a first way 502 of the valve 500. It comprises a body which defines a conical seat 410 flared in moving away from the inlet coming from the internal volume 202 of the casing 200, a stopper 420 placed downstream of the seat 410 relative to a supply direction of fluid going from the internal volume 202 of the casing 200 towards the internal volume 102 of the sleeve 100 and a spring 430 which stresses the stopper 420 in sealing abutment against the seat 410 and in the process stresses the valve 400 on closing.

The seat 410 and the stopper 420 are advantageously made of metal defining a metal/metal valve 400.

At rest, the valve 400 is closed under the stressing of the spring 430. When the pressure exerted from upstream to downstream by fluid applied from the internal volume 202 of the casing 200 exceeds the taring force exerted by the spring 430, this pressure repels the stopper 420 and opens the valve 400. However any pressure exerted from downstream to upstream, that is, from the internal volume 102 of the sleeve 100, tends to reinforce the stressing of the stopper 420 against its seat and therefore the valve 300 on closing.

The two other ways 504 and 506 of the valve 500 are connected respectively to the internal volume 102 of the sleeve 100 and the annular volume EA1 of the well P.

In the initial state shown in FIG. 6, the valve 500 ensures a link between the ways 502 and 504 and consequently between the output of the valve 400, or the internal volume 202 of the casing 200, when the valve 400 is open, and the internal volume 102 of the sleeve 100.

In the final switched state shown in FIG. 7, the valve 500 ensures a link between the ways 504 and 506. The link between the outlet of the valve 400 and the internal volume 102 of the sleeve 100 is interrupted and a link is set up between the internal volume 102 of the sleeve 100 and the annular volume EA1 of the well.

As will be described in more detail later on, the final state shown in FIG. 7 is obtained after rupture or degradation of a pin 590 associated with the piston of the drawer 500. It is clear that the pressure applied from the non-return valve 400 remains in the internal volume 102 of the sleeve 100 until rupture or degradation of the pin 590.

As indicated previously, the valve 500 comprises a piston adapted to define in the final switched state a second valve 510 of direction opposite the valve 400, on the passage leading from the internal volume 202 of the casing 200 to the internal volume 102 of the sleeve 100. The resulting equivalent drawing of the assembly 300 in the switched state final is shown in FIG. 8. This FIG. 8 shows the valve 510 comprising a body which defines a conical seat 512 flared in moving towards the inlet coming from the internal volume 202 of the casing 200, a stopper 514 placed upstream of the seat 512 relative to a direction of supply of fluid going from the internal volume 202 of the casing 200 towards the internal volume 102 of the sleeve 100 and a spring 516 which stresses the stopper 514 in sealing abutment against the seat 512 and in the process stresses the valve 510 on closing.

The seat 512 and the stopper 514 are advantageously made of metal defining a metal/metal valve 500.

In the initial state of the valve 500, the valve 510 is open. During switching of the valve 500 after rupture or degradation of the pin 590, the valve 510 closes under stressing of the spring 516. The assembly comprises two valves 400 and 510 of opposite direction, back-to-back, which prohibit any circulation of fluid in any direction between the internal volume 202 of the casing 200 and the internal volume 102 of the sleeve 100.

The structure and operation of the assembly 300 according to a second variant embodiment of the present invention will now be described, illustrated in FIGS. 9 to 11 and also comprising in combination a three-way valve 500 with two positions and a non-return inlet valve 400.

The assembly illustrated in appended FIGS. 9 to 11 differs essentially from the first embodiment illustrated in FIGS. 6 to 8 by the fact that the direction of the valves 400 and 510 are reversed and the inlet valve 400 initially held open is closed after rupture or degradation of a pin 490.

The non-return valve 400 is placed in the conduit coming from the internal volume 202 of the casing 200 and leading to the first way 502 of the valve 500. It comprises a body which defines a conical seat 410 flared in moving towards the inlet coming from the internal volume 202 of the casing 200, a stopper 420 placed upstream of the seat 410 relative to a direction for supply of fluid going from the internal volume 202 of the casing 200 towards the internal volume 102 of the sleeve 100 and a spring 430 which stresses the stopper 420 in sealing abutment against the seat 410 and in the process stresses the valve 400 on closing.

Here too the seat 410 and the stopper 420 are advantageously made of metal defining a metal/metal valve 400.

In the initial state the stopper 420 is however held away from the seat 410 by a pin 490 likely to rupture or degrade, as illustrated in FIG. 9. The valve 400 is open. The valve 400 switches to the state closed during rupture or degradation of the pin 490 under stressing of the spring 430.

As for the first embodiment, the two other ways 504 and 506 of the valve 500 are connected respectively to the internal volume 102 of the sleeve 100 and the annular volume EA1 of the well P and in the initial state shown in FIG. 9, the valve 500 ensures a link between the ways 502 and 504 and consequently between the output of the valve 400, that is the internal volume 202 of the casing 200, as the valve 400 is open, and the internal volume 102 of the sleeve 100. In the final switched state shown in FIG. 10, the valve 500 ensures a link between the ways 504 and 506. The link between the output of the valve 400 and the internal volume 102 of the sleeve 100 is interrupted and a link is set up between the internal volume 102 of the sleeve 100 and the annular volume EA1 of the well. The final state shown in FIG. 10 is also obtained after rupture or degradation of a pin 590 associated with the piston of the drawer 500.

The equivalent drawing of the resulting assembly 300 in the final switched state of the second embodiment is shown in FIG. 11. This FIG. 11 shows the valve 510 formed by the piston of the valve 500, comprising a body which defines a conical seat 512 flared in moving away from the inlet coming from the internal volume 202 of the casing 200, a stopper 514 placed downstream of the seat 512 relative to a direction for supply of fluid going from the internal volume 202 of the casing 200 towards the internal volume 102 of the sleeve 100 and a spring 516 which stresses the stopper 514 in sealing abutment against the seat 512 and in the process stresses the valve 510 on closing.

In the initial state of the valve 500, the valve 510 is open. During switching of the valve 500 after rupture or degradation of the pin 590, the valve 510 closes under stressing of the spring 516. The assembly comprises two valves 400 and 510 of opposite direction, face-to-face, which prohibit any circulation of fluid in any direction between the internal volume 202 of the casing 200 and the internal volume 102 of the sleeve 100.

The three-way valve 500 can be the object of many embodiments. It preferably comprises a piston 550 equipped with and/or associated with a stopper 514 made of metal mounted in translation in a metal body 310 of the assembly. More precisely the piston 550 is mounted in translation in a chamber 320 of this body 310 in which conduits corresponding to the ways 502, 504 and 506 terminate and are connected respectively to the internal volume 202 of the casing 200, the internal volume 102 of the sleeve 100 and the internal volume EA1 of the well P.

Throughout the description the concept of "body 310" must be understood without any limitation, the body 310 comprising the assembly of the casing which houses the functional elements of the three-way valve 500 and if required of the inlet valve 400, and can comprise several pieces.

The chamber 320 and the piston 550 are set out spaced and the conduits 502, 504 and 506 terminate at points distributed longitudinally in the internal chamber 320 such that as a function of the axial position of the piston 550 in the chamber 320 two of the conduits 502 and 504 or 504 and 506 are successively connected.

According to another advantageous characteristic of the present invention, the inlet valve 400 and the valve 500 are preferably formed in separate parallel longitudinal channels formed in the body 310 of the assembly 300 parallel to the longitudinal axis of the casing 200, the above longitudinal channels being connected by transversal passages.

The embodiment illustrated in FIGS. 12 to 16 which corresponds to a first embodiment of an assembly 300 according to the present invention comprising a three-way valve 500 held initially by a degradable pin 590 and comprising in the switched state two opposite valves back-to-back 400 and 510 will now be described.

Throughout the description the terms "upstream" and "downstream" will be used in reference to the direction of displacement of a fluid from the internal volume 202 of the casing 200 towards the internal volume 102 of the sleeve 100.

According to this first example, the assembly 300 comprises in the body 310 two longitudinal channels 330 and 340 parallel to each other and parallel to the axis O-O of the casing 200. The channels 330 and 340 are located in different radial planes. The channel 330 houses the inlet valve 400. The channel 340 houses the three-way valve 500.

The longitudinal channel 330 communicates with the internal volume 202 of the casing 200, on a first axial end, via a radial channel 312 blocked at its radially external end by a stopper 314.

Near its second axial end which receives the non-return valve 400, the longitudinal channel 330 communicates with the second longitudinal channel 340 via a transversal passage 316.

The longitudinal channel 340 has a second transversal passage 318 which communicates with the internal volume 102 of the sleeve and an orifice 350 which terminates radially towards the exterior in the annular volume EA1 of the well.

The passage 316, the passage 318 and the orifice 350 form the three ways 502, 504 and 506 of the valve 500.

FIG. 12 shows a parachute valve 360 mounted on the radially internal inlet end of the channel radial 312. The valve 360 comprises a stopper 362 in the form of a mushroom whereof the flared head is directed towards the internal volume 202 of the casing 200. The stopper 362 is stressed open by a spring supported on the stopper 314 to keep the valve 360 open, at rest, and enable supply of the internal volume 102 of the expandable sleeve 100.

The role of the valve 360 is to close the channel 312 if the fluid flow exceeds a threshold, for example in case of rupture of the expandable sleeve 100. This closing of the valve 360 occurs when the loss of charge at the inlet of the latter creates a force greater than taring of the associated spring on the flared head of the stopper 362.

As is clear from FIG. 22 such a parachute inlet valve 360 can equip all the embodiments according to the invention.

The first longitudinal channel 330 has a divergent conical area 410 in moving away from the first end linked to the radial inlet channel 312 and which forms the above seat of the valve 400. This conical area 410 is located upstream of the channel 316.

As is clear from FIG. 12 the channel 330 houses, facing this seat 410, a stopper 420 comprising a complementary conical end stressed supported against the seat 410 by a spring 430.

As described previously for FIGS. 6 to 8, such a valve 400 is closed at rest and opens when the valve 500 is passing between the internal volume 202 of the casing 200 and the internal volume 102 of the sleeve 100, the pressure exerted on the stopper 420 by the fluid present in the casing 200 exceeds the force of the spring 430.

The second longitudinal channel 340 has a conical area 512 located axially between the two conduits 316 and 318. The area 512 is divergent in moving towards the first conduit 316 and forms the above seat of the valve 510.

It is observed in FIGS. 13 to 16 that the channel 340 houses a piston 550 and a stopper 514 capable of translation.

The stopper 514 is placed upstream of the piston 550 and rests on the end upstream 556 of the piston 550. Facing the seat 512 it has a conical area complementary to the seat 512. The stopper 514, is stressed supported against the seat 512 by a spring 516.

However, at rest in initial position the stopper conical 514 is held away from the seat 512 by the piston 550 and a degradable pin 590 placed in the base of the channel 340 facing a piston tail 552 axially extending the piston 550 downstream of the stopper 514.

It is observed from FIGS. 13 to 16 that the channel 340 houses also an O-ring 370 or any other equivalent means (O-ring associated with a ring for example) in contact with an intermediate portion 554 of the piston 550. The ring 370 is placed axially between the conduit 318 and the orifice 350, which conduit 318 and orifice 350 are both located downstream of the seat 512. As seen on FIG. 15 the ring 370 ensures sealing with the external surface of the piston 550 in initial position of the three-way valve 500 and until displacement of the stopper 514 against the seat 512. The ring 370 therefore insulates the downstream orifice 350, in initial position illustrated in FIGS. 13 and 14 in which communication is authorised between the internal volume 202 of the casing 200 and the internal volume 102 of the sleeve 100 by means of conduits 316 and 318 and in intermediate position illustrated in FIG. 15 in which communication between the internal volume 202 of the casing 200 and the internal volume 102 of the sleeve 100 is interrupted by contact of the stopper 514 against the seat 512.

This spring 560 is interposed between a detachment formed in the channel 340 and a flared head 553 formed on the end downstream of the piston tail 552.

It is observed that the body 310 preferably has a radial orifice 352 terminating at the level of the chamber which houses the degradable pin 590 and receives the flared head 553 to allow evacuation of the material constituting the pin 590 and free displacement of the head 553.

After degradation of the pin 590, the piston 550 is moved in translation in the channel 340 under the effect of the spring 560. The portion 554 of the piston 550 escapes the ring 370 and communication is authorised between the conduit 318 linked to the internal volume 102 of the sleeve 100 and the orifice 350 which terminates in the annular volume EA1 of the well. In the position illustrated in FIG. 16, the valve 500 has reached its final irreversible switched position, the stopper 514 remaining supported against its seat 512 to insulate the conduit 316 from the conduit 318.

FIGS. 17 and 18 illustrate a second embodiment of a valve 500 according to the present invention intended to form in the switched state, in combination with the inlet valve 400, two opposite valves back-to-back, which differ essentially from the first embodiment illustrated in FIGS. 12 to 16 by the fact that the above degradable pin 590 is replaced by a rupture pin 592.

This rupture pin 592 is carried by the body 310. It is oriented radially relative to the direction of translation of the piston 550 in the longitudinal channel 340 and interferes initially with the piston 550 or a stop 593 on which the piston 550 rests, as seen in FIG. 17 to prevent displacement of the piston 550 and consequently rapprochement of the stopper 514 against the seat 512. The conduits 316 and 318 are then in communication.

After rupture under the combined effect of the pressure differential between the internal pressure in the sleeve 100 and the pressure of the annular EA1 and of the spring 560, the pin 592 releases the piston 550 such that in an intermediate state the stopper 514 is supported against the seat 512, the conduits 316 and 318 and the orifice 350 are isolated, then in the final switched state illustrated in FIG. 18, the piston 550 completes its course under the effect of the spring 560 such that a link is set up between the conduit 318 and the orifice 350.

FIGS. 19, 20 and 21 illustrate a third embodiment of a valve according to the present invention intended to form in the switched state, in combination with the inlet valve 400, two opposite valves back-to-back, which differ essentially from the first embodiment illustrated in FIGS. 12 to 16 and from the second embodiment illustrated in FIGS. 17 and 18, by the fact that piston 550 is held initially by the combination of a degradable pin 590 and a rupture pin 592.

The degradable pin 590 is interposed between the tail 552 of the piston 550 and a stop 593 attached to the rupture pin 592.

The rupture pin 592 initially prohibits displacement of the piston 550 and consequently rapprochement of the stopper 514 against the seat 512. The conduits 316 and 318 are then in communication, as illustrated in FIG. 19.

After rupture under the combined effect of the pressure differential between the internal pressure of the sleeve 100 and the pressure of the annular EA1 and of the spring 560, the pin 592 releases the piston 550 such that in an intermediate state the stopper 514 is supported against the seat 512, the conduits 316 and 318 and the orifice 350 are thus isolated, then in the final switched state illustrated in FIG. 20, the piston 550 completes its course under the effect of the spring 560 such that a link is set up between the conduit 318 and the orifice 350, the portion 554 of the piston 550 escaping the ring 370.

In case of deficiency of the pin 592, if the latter does not break, the degradable pin 590 ends up degrading after some time, after inflation of the sleeve 100, as illustrated in FIG. 21, to also authorise switching in the final state of the valve 500 in which the conduit 318 and the orifice 350 communicate, but the inlet conduit 316 remains blocked by the valve 510.

The fourth embodiment of an assembly 300 according to the present invention illustrated in appended FIGS. 22 to 30, comprising an inlet valve 400 stressed on closing but held initially in the open position by a degradable and/or rupture pin 490 and a valve 500 initially held by a degradable and/or rupture pin 590 and forming in the switched state two opposite valves 400 and 510 face-to-face will now be described.

According to this fourth example, the assembly 300 comprises in the body 310, four longitudinal channels 332, 330, 340 and 442 parallel to each other and parallel to the axis O-O of the casing 200, seen respectively in FIGS. 22, 23, 24 and 26. The channels 332, 330, 340 and 442 are located in different radial planes.

The longitudinal channel 332 seen in FIG. 22 is an inlet channel which communicates with the internal volume 202 of the casing 200, on a first axial end, by a radial channel 312 blocked at its radially external end by a stopper 314 and equipped with a parachute valve 360.

Near its second axial end blocked by a stopper 315, the channel 332 communicates via a transversal channel 317 with the longitudinal channel 330.

The longitudinal channel 330 seen in FIG. 23 receives the non-return valve 400. This longitudinal channel 330 communicates with the third longitudinal channel 340 seen in FIGS. 24 and 25 via a transversal passage 316. FIG. 23 shows the place where the transversal inlet channel 317 terminates in the longitudinal channel 330, behind a piston valve 450 illustrated in FIG. 23.

The longitudinal channel 340 houses the three-way valve 500.

The transversal inlet channel 316 terminates on a blind axial end of the longitudinal channel 340.

The longitudinal channel 340 has a second transversal passage 318 which communicates with the fourth longitudinal channel 342 seen in FIG. 26, which terminates in the internal volume 102 of the sleeve 100, and an orifice 350 which terminates radially towards the exterior in the annular volume EA1 of the well.

The passage 316, the passage 318 and the orifice 350 form the three ways 502, 504 and 506 of the valve 500.

The longitudinal channel 330 has a conical divergent area 410 in moving towards the inlet channel 332 and which forms the above seat of the valve 400. This conical area 410 is located downstream of the channel 317 and upstream of the channel 316.

As is seen in FIG. 23, the channel 330 houses, facing this seat 410, a stopper 420 formed on the piston 450 and comprising a stressed complementary conical end supported against the seat 410 by a spring 430.

As described previously for FIGS. 9 to 11, such a valve 400 is held open initially by a degradable pin 490 or one likely to rupture and closes when the pin 490 is broken or degraded.

According to the particular and non-limiting embodiment illustrated in FIG. 23, the pin 490 is a degradable pin placed facing the downstream end of the piston 450, beyond the conduit 316, in the base of the longitudinal channel 330.

The longitudinal channel 340 has a conical area 512 located axially between the two conduits 316 and 318. The area 512 is divergent in moving away from the first conduit 316 and forms the seat above the valve 510.

As is seen in FIGS. 24, 25, 27, 28 and 30 the channel 340 houses a piston 550 capable of translation.

The piston 550 has, facing the seat 512, a conical area 514 complementary to the seat 512, forming a stopper. The piston 550, more particularly the stopper 514, is stressed supported against the seat 512 by a spring 516.

However at rest in the initial position as illustrated in FIGS. 24 and 25, the stopper conical 514 is held away from the seat 512 by a degradable pin, a rupture pin or the combination of a degradable pin and a rupture pin.

Such degradable or rupture pins have not been shown in FIGS. 24 to 30 to simplify illustration. They can comply with dispositions previously described for FIGS. 13 to 21.

It will be clear from FIGS. 24, 25, 27, 28 and 30 that the channel 340 also houses two O-rings 370 and 372 or any other equivalent means (O-ring associated with a ring for example) in contact with a portion 554 of the piston 550 adjacent to the conical stopper 514.

The ring 370 is placed axially between the conduit 318 and the orifice 350, which conduit 318 and orifice 350 are both located downstream of the seat 512. As is seen in FIGS. 24 and 25, the ring 370 ensures sealing with the external surface of the piston 550 in initial position of the three-way valve 500 and until displacement of the stopper 514 against the seat 512. The ring 370 therefore insulates the downstream orifice 350, in initial position illustrated in FIGS. 24 and 25 in which communication is enabled between the internal volume 202 of the casing 200 and the internal volume 102 of the sleeve 100 by means of conduits 316 and 318 and in intermediate transitory position illustrated in FIG. 27 in which communication between the internal volume 202 of the casing 200 and the internal volume 102 of the sleeve 100 is interrupted by the piston 550.

The ring 372 is placed axially between the conduit 316 and the conduit 318, downstream of the seat 512, the conduits 316 and 318 being located respectively on either side of the seat 512. The ring 372 ensures sealing on the piston 550 and insulates the two conduits 316 and 318 in case of leak of the valve 510, especially in the transitory displacement phase of the piston towards its final switched position, as illustrated in FIG. 27.

This final switched position in which the stopper 514 formed on the piston 550 rests against the seat 512 is illustrated in FIG. 28. In this final switched position, the piston 550 has a portion 555 of reduced cross-section facing the ring 370 such that the ring 370 no longer ensures sealing on the piston 550. Communication is enabled between the conduit 318 and the output 350. However, as seen in FIGS. 27, 28 and 30, once the piston 550 has reached the ring 372, the latter remains in sealing contact with the external surface of the piston to isolate the inlet way 316.

FIG. 29 shows the inlet valve 400 in closed switched position, the stopper 420 resting against the seat 410 after degradation of the pin 490.

It will be evident according to the fourth embodiment illustrated in FIGS. 22 to 30 that the piston 550 of the valve 500 is associated with a non-return mechanism 580 which prohibits rearwards displacement of the piston such that the piston 550 might escape the ring 372, once switching is initiated. Such a mechanism 580 can form the object of many embodiments. According to the particular and non-limiting embodiment illustrated in FIGS. 24, 25, 28 and 30 this mechanism 580 is formed from a piece 582 interposed between the piston 550 and the spring 516, which has two support faces 584 and 586 directed respectively towards the piston 550 and towards the spring 516, not parallel to each other.

The straight section of the piece 582 is less than the straight section of the local area of the channel 340 to allow engagement and flow of this piece 582. During switching however, the piece 582 is moved obliquely in the channel 340 and according to a diagonal of greater length is now facing a detachment 348 formed in the channel 340. Cooperation of the piece 582 and of the detachment 348 illustrated in FIG. 30 prohibits the return of the piston 550 to its original position.

Such a mechanism 580 is however optional and non obligatory.

The use of two non-return valves 400 and 510 in series and in opposite directions between the internal volume 202 of the casing 200 and the internal volume 102 of the expandable sleeve 100 ensures good sealing. And the use of metal/metal valves due to metal stoppers 420 and 514 resting on conical metal seats 410 and 512 ensures reliable sealing in severe environmental conditions of drilling wells.

Those skilled in the art will understand that according to all the above embodiments according to the invention, the insulation device integrates a three-way valve 500 comprising a single switching piston 550 such that:

- During a phase for placing the insulation annular device in a well, the device is in communication with the interior of the casing 200 such that the pressures between the interior of the sleeve 100 and the interior of the casing 200 are balanced. On the other hand, there is no possible communication between the internal volume 102 of the sleeve 100 and the annular space EA1 or EA2 or between the casing 200 and the annular space EA1 or EA2.
- During an inflation phase, the internal volume 102 of the sleeve 100 is in communication with the interior of the casing 200. So when the pressure rises in the casing 200, the pressure rises in the same way in the sleeve 100. On the other hand, there is no possible communication between the internal volume 102 of the sleeve 100 and the annular space EA1 or between the casing 200 and the annular space EA1.
- On completion of inflation, the movement of the piston 550 is released by the rupture of a pin 590 comprising material which degrades over time and/or by rupture of a pin 592 resulting from a rise in pressure differential which inflates the device. Whether it is degradable or not, rupturing of the pin 590 or 592 definitively releases movement of the piston 550 which closes off communication between the casing 200 and the internal volume 102 of the sleeve 100 and which at the same time opens communication between the internal volume 102 of the sleeve 100 and the annular volume EA1. After rupture of the pin 590 or 592, it is no longer possible to inflate the annular insulation device from the casing.

The valve 500 is constituted such that reverse movement of the piston 550 is impossible even if there is a pressure differential, positive or negative, between the annular space EA1 and the interior of the casing 200.

When a pressure differential is applied from EA1 to EA2 such that $P_{EA1}>P_{EA2}$, the fluid, and therefore the pressure, communicates inside the expandable sleeve 100 via the conduits 318 and 350 of the valve 500. Pressure internal to the expandable membrane 100 is identical to the pressure of the annular area EA1 which imparts excellent insulation area properties.

The invention resolves the problems raised by the prior art.

If annular pressure varies over time and can be alternatively pressure of EA1>pressure of EA2 or pressure of EA2>pressure of EA1, it is feasible to show two area insulation devices according to the invention head to tail as illustrated in FIG. 31.

Of course, the present invention is not limited to the specific embodiments just described, but extends to any variant according to its central meaning.

Valves 400 and 510 have been described previously whereof the seat 410, 512 and the stopper 420, 514 are advantageously made of metal, defining metal/metal valves 400, 510.

If appropriate, to eliminate any risk of sealing defect between such a metal stopper and its associated metal seat, means can be provided for accidental sealing formed by an O-ring (or any equivalent means, for example an O-ring associated with a ring) adapted to be supported on a complementary bearing surface when the valve is in its closing position or near its closing position. Therefore the valve 400 and/or 510 is and remains sealed even if the stopper 420 or 514 may not remain right up against its associated seat 410 or 512, for example in the event where conveyed fluid is not correctly filtered.

Such an additional ring can be provided on the stopper and be adapted to be supported against a complementary bearing surface formed on the body housing the valve and forming the seat, when the valve is in its closing position or near its closing position. As a variant the ring can be provided on the body housing the valve and forming the seat, and be adapted to be supported against a complementary bearing surface formed on the stopper, when the valve is in its closing position or near its closing position.

By way of non-limiting example FIGS. 32 to 34, which illustrate an alternative of the embodiment shown in FIGS. 13 to 16, show an embodiment in which an additional ring 570 is mounted in a throat formed on the stopper 514. This ring 570 is adapted to be supported against a complementary bearing surface 511 formed at the level of detachment on the body 310 housing the valve 510, in the extension and upstream of the seat 512. The diameter of the section of the chamber 320 which receives the stopper 514 and which houses the ring 370 in initial position such as illustrated in FIG. 32, is preferably greater than the diameter of the ring 370. The diameter of the detachment which forms the bearing surface 511 is however at least slightly less than the external resting diameter of the ring 570 to ensure such sealing.

It will be evident preferably that the course of the stopper 514 is such that in initial position as illustrated in FIG. 32 the ring 570 is placed beyond the inlet conduit 316 so as not to perturb fluid flow and ensure inflation of the sleeve 100. In other terms the conduit 316 is located, in initial position, between the ring 570 and the bearing surface 511.

FIG. 33 shows the valve 510 in closed position similar to FIG. 16, the stopper 514 resting against the seat 512.

FIG. 34 shows the sealing ensured by the ring 570 resting against the bearing surface 511 in the event where the stopper 514 is slightly removed from the complementary conical seat 512.

As indicated previously the disposition of an additional ring ensuring sealing of the valve in case of removal of the stopper can apply equally well to all embodiments of the valve 510 as to all embodiments of the valve 400, and this is in ring version mounted on the stopper cooperating with a complementary bearing surface formed on the seat side or in ring version mounted on the seat side and cooperating with a complementary bearing surface formed on the stopper.

FIG. 35 illustrates, in the open position, a variant embodiment of the valve 510 according to which the ring 570 is placed in a throat 311 formed in the body 310 integrating the seat 512 to cooperate with a complementary bearing surface 515 formed on the stopper 514.

FIG. 36 illustrates, in closed position, a variant embodiment of a valve 400 according to which a ring 470 is placed in a throat 422 formed in the body of the stopper 420 to cooperate with a complementary bearing surface 412 formed on the body 310 integrating the seat 410.

FIG. 37 illustrates, in closed position, another variant embodiment of a valve 400 according to which a ring 470 is placed in a throat 313 formed in the body 310 integrating the seat 410 to cooperate with a complementary bearing surface 424 formed on the stopper 420.

The invention claimed is:

1. An insulation device for treatment of a well, comprising an expandable sleeve placed on a casing and an assembly adapted to control the supply of the internal volume of the sleeve by pressurised fluid coming from the casing, via a passage passing through the wall of the casing, to radially expand the sleeve towards the exterior, wherein said assembly comprises a non-return valve placed in a passage which connects the internal volume of the casing to the internal volume of the sleeve and a three-way valve adapted to control the passage between the internal volume of the casing and the internal volume of the sleeve and a passage between the internal volume of the sleeve and an annular volume of the well external to the sleeve and the casing, said three-way valve and said non-return valve forming two valves mounted in series and in opposite directions, wherein the three-way valve is adapted to be switched a single time between an initial state in which a flow path is set up between the internal volume of the casing and the internal volume of the sleeve to expand said sleeve and a final state in which the flow path between the internal volume of the casing and the internal volume of the sleeve is interrupted and a flow path is set up between the internal volume of the sleeve and an annular volume of the well external to the sleeve and the casing, and wherein said two valves mounted in series and in opposite directions after switching of the three-way valve are on the passage connecting the internal volume of the casing and the internal volume of the expandable sleeve.

2. The device according to claim 1, wherein the a three-way valve define a temporary intermediate state which occurs between the initial state and the final state and in which the flow path between the internal volume of the casing and the internal volume of the sleeve is interrupted, but the flow path between the internal volume of the sleeve and the annular volume of the well external to the sleeve and the casing is not yet set up.

3. The device according to claim 1, wherein the non-return valve placed in the passage which connects the internal volume of the casing to the internal volume of the sleeve is a valve stressed elastically on closing, which opens under fluid pressure which acts in the direction going from the internal volume of the casing towards the internal volume of the sleeve.

4. The device according to claim 1, wherein the non-return valve placed in the passage which connects the internal volume of the casing to the internal volume of the sleeve is a valve stressed elastically on closing, which opens under fluid pressure which acts in the direction going from the internal volume of the sleeve towards the internal volume of the casing, said valve initially being held in the open position by temporary means, for example a retaining element likely to rupture and/or degrade.

5. The device according to claim 1, wherein the valves are non-return valves in which a metal stopper rests on a metal seat.

6. The device according to claim 1, wherein the valves are non-return valves with conical seat.

7. The device according to claim 1, wherein the valves comprise a ring adapted to rest against a complementary bearing surface when the valve is in its closing position or near its closing position.

8. The device according to claim 7, wherein the ring is provided on the stopper and is adapted to be supported against a complementary bearing surface formed on the body housing the valve and forming the seat, or is provided on the body housing the valve and forming the seat, and is adapted to be supported against a complementary bearing surface formed on the stopper.

9. The device according to claim 1, wherein the non-return valve placed in the passage which connects the internal volume of the casing to the internal volume of the sleeve and the three-way valve are formed by two separate sub-assemblies.

10. The device according to claim 1, wherein the non-return valve placed in the passage which connects the internal volume of the casing to the internal volume of the sleeve and the three-way valve are places in separate parallel longitudinal channels formed in the body of the assembly.

11. The device according to claim 1, wherein the means which control the closing of the communication between the internal volume of the casing and the internal volume of the sleeve comprise a retaining element likely to rupture or a retaining element likely to degrade or a combination of a first retaining element which must break with a second retaining element which must degrade.

12. The device according to claim 1, wherein the three-way valve comprises a body which defines a chamber in which communication conduits terminate respectively with the interior of the casing, the interior of the expandable sleeve and the annular space located outside the casing, a piston mounted in translation in said chamber and releasable immobilisation means, frangible and/or degradable, which initially immobilise the piston in an initial position such that the piston authorise communication only between the associated conduits inside the casing and inside the expandable sleeve, then release the piston such that the piston occupies a final position in which it authorises communication between the associated conduits inside the expandable sleeve and the annular space located outside the casing while prohibiting any renewed switching towards the initial position when the piston has reached the final position.

13. The device according to claim 12, wherein the piston and the releasable immobilisation means define an intermediate position between the initial position and the final position, in which the three communication conduits associated respectively with the interior of the casing, the interior of the expandable sleeve and the annular space located outside the casing are insulated from each other.

14. An assembly for use in an insulation device for treatment of a well, the insulation device including an expandable sleeve placed on a casing, the assembly adapted to control the supply of the internal volume of the sleeve by pressurised fluid coming from the casing, via a passage passing through the wall of the casing, to radially expand the sleeve towards the exterior, the assembly comprising:

a non-return valve, and a three-way valve adapted to be switched a single time between an initial state in which a flow path is set up between the internal volume of the casing and the internal volume of the sleeve to expand said sleeve and a final state in which the flow path between the internal volume of the casing and the internal volume of the sleeve is interrupted and a flow path is set up between the internal volume of the sleeve and an annular volume of the well external to the sleeve and the casing, wherein the valves form, after switching, two valves mounted in series and in opposite directions, back-to-back or face-to-face, on the passage connecting the internal volumes of the casing and the sleeve of the well insulation device.

15. The assembly according to claim 14, wherein the valves are non-return valves in which a metal stopper rests on a conical metal seat.

16. A method for insulation of two annular areas of a well, performing a supply step of an expandable sleeve placed on a casing by pressurised fluid coming from the casing, to expand the sleeve radially towards the exterior, wherein it comprises the steps consisting of supplying the internal volume of the expandable sleeve by a non-return valve placed in a passage which connects the internal volume of the casing to the internal volume of the sleeve wherein said method further comprises the step of then operating switching of a three-way valve between an initial state in which a flow path is set up between the internal volume of the casing and the internal volume of the sleeve to expand said sleeve and a final state in which the flow path between the internal volume of the casing and the internal volume of the sleeve is interrupted and a flow path is set up between the internal volume of the sleeve and an annular volume of the well external to the sleeve and the casing, said three-way valve and said non-return valve forming, after switching, two valves mounted in series and in opposite directions on the passage connecting the internal volumes of the casing and of the sleeve.

17. An insulation device for treatment of a well, comprising an expandable sleeve placed on a casing and an assembly adapted to control the supply of the internal volume of the sleeve by pressurised fluid coming from the casing, via a passage passing through the wall of the casing, to radially expand the sleeve towards the exterior, wherein said assembly comprises a non-return valve placed in a passage which connects the internal volume of the casing to the internal volume of the sleeve and a three-way valve adapted to control the passage between the internal volume of the casing and the internal volume of the sleeve and a passage between the internal volume of the sleeve and an annular volume of the well external to the sleeve and the casing, said three-way valve and said non-return valve forming two valves mounted in series and in opposite directions, wherein the three-way valve is adapted to be switched a single time between an initial state in which a flow path is set up between the internal volume of the casing and the internal volume of the sleeve to expand said sleeve and a final state in which the flow path between the internal volume of the casing and the internal volume of the sleeve is interrupted and a flow path is set up between the internal volume of the sleeve and an annular volume of the well external to the sleeve and the casing, wherein said two valves mounted in series and in opposite directions after switching of the three-way valve are on the passage connecting the internal volume of the casing and the internal volume of the expandable sleeve, and wherein the three-way valve comprises a body which defines a chamber in which communication conduits terminate respectively with the interior of the casing, the interior of the expandable sleeve and the annular space located outside the casing, a piston mounted in translation in said chamber and releasable immobilisation means, frangible and/or degradable, which initially immobilise the piston in an initial position such that the piston authorise communication only between the associated conduits inside the casing and inside the expandable sleeve, then release the piston such that the piston occupies a final position in which it authorises communication between the associated conduits inside the expandable sleeve and the annular space located outside the casing while prohibiting any renewed switching towards the initial position when the piston has reached the final position.

18. The device according to claim 17, wherein the piston and the releasable immobilisation means define an intermediate position between the initial position and the final position, in which the three communication conduits associated respectively with the interior of the casing, the interior of the expandable sleeve and the annular space located outside the casing are insulated from each other.

* * * * *